US009752523B2

(12) United States Patent
Yoshikawa et al.

(10) Patent No.: US 9,752,523 B2
(45) Date of Patent: Sep. 5, 2017

(54) AIR-FUEL RATIO CONTROL APPARATUS FOR INTERNAL COMBUSTION ENGINE

(71) Applicant: TOYOTA JIDOSHA KABUSHIKI KAISHA, Toyota-shi, Aichi-ken (JP)

(72) Inventors: Yuya Yoshikawa, Chiryu (JP); Tokiji Ito, Toyota (JP); Isao Nakajima, Nisshin (JP); Hiroaki Tsuji, Miyoshi (JP); Toshihiro Kato, Toyota (JP); Yoshihisa Oda, Toyota (JP); Masashi Hakariya, Nagoya (JP); Masahide Okada, Anjou (JP); Yoshifumi Matsuda, Toyota (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 14/785,030

(22) PCT Filed: Mar. 28, 2014

(86) PCT No.: PCT/JP2014/001818

§ 371 (c)(1),
(2) Date: Oct. 16, 2015

(87) PCT Pub. No.: WO2014/171080

PCT Pub. Date: Oct. 23, 2014

(65) Prior Publication Data

US 2016/0076474 A1 Mar. 17, 2016

(30) Foreign Application Priority Data

Apr. 19, 2013 (JP) ..... 2013-088519

(51) Int. Cl.

| | |
|---|---|
| ***F02D 41/14*** | (2006.01) |
| ***F02D 41/24*** | (2006.01) |
| *F02D 41/00* | (2006.01) |

(52) U.S. Cl.
CPC ..... *F02D 41/1454* (2013.01); *F02D 41/1441* (2013.01); *F02D 41/1456* (2013.01);
(Continued)

(58) Field of Classification Search
CPC ..... F02D 41/1454; F02D 41/1441; F02D 41/1456; F02D 41/1495; F02D 41/2054;
(Continued)

(56) References Cited

U.S. PATENT DOCUMENTS 4,817,384 A * 4/1989 Okumura ..... F02D 41/1441 123/691
5,473,889 A * 12/1995 Ehar ..... F02D 41/1441 60/276

(Continued)

FOREIGN PATENT DOCUMENTS

JP 2005-036742 A 2/2005
JP 2005-337139 A 12/2005

(Continued)

*Primary Examiner* — Hieu T Vo
(74) *Attorney, Agent, or Firm* — Andrews Kurth Kenyon LLP

(57) ABSTRACT

An air-fuel ratio control apparatus for an internal combustion engine is provided. A controller is programmed to perform correction amount guard control allowing adjustment of a correction amount by setting a limit on the correction amount when an appearance frequency of a state where an output value from a downstream sensor is leaner than a predetermined value is equal to or higher than a predetermined value. When a state where the output value from the downstream sensor is leaner than the predetermined value lasts for a duration equal to or longer than a predetermined time, an incorporation speed at which, during learning control, the correction amount for sub feedback control is incorporated into a learning value is set to a larger value that when the duration is shorter than the predeter- (Continued)

mined time, and performance of the correction amount guard control is suppressed until the learning control is completed.

2 Claims, 17 Drawing Sheets

(52) U.S. Cl.
CPC ..... *F02D 41/1495* (2013.01); *F02D 41/2454* (2013.01); *F02D 41/0085* (2013.01); *F02D 2041/1422* (2013.01)

(58) Field of Classification Search
CPC ..... F02D 41/0085; F02D 2041/1422; F02D 41/2461
USPC ..... 701/101, 102, 103, 109, 107
See application file for complete search history.

(56) References Cited

U.S. PATENT DOCUMENTS 5,619,976 A * 4/1997 Kitagawa ..... F02D 41/1402 123/679
5,732,689 A * 3/1998 Ohno ..... F02D 41/008 123/673
8,122,869 B2 * 2/2012 Fujiwara ..... F02D 13/023 123/345
9,291,085 B2 * 3/2016 Yanase ..... F01N 11/007
9,441,562 B2 * 9/2016 Odendall ..... F02D 41/0295
2003/0131587 A1 * 7/2003 Kawamura ..... F01N 11/00 60/276
2004/0209734 A1 * 10/2004 Mitsutani ..... F02D 41/0295 477/111
2005/0076634 A1 * 4/2005 Anilovich ..... F02D 41/1495 60/274
2006/0130457 A1 * 6/2006 Hirowatari ..... F02D 41/1441 60/276
2009/0139213 A1 * 6/2009 Mukai ..... F01N 9/00 60/277
2009/0211350 A1 * 8/2009 Iwazaki ..... G01M 15/104 73/114.72
2009/0306879 A1 * 12/2009 Takubo ..... F02D 41/0032 701/104
2010/0108046 A1 * 5/2010 Nakagawa ..... F02D 41/2461 123/674
2010/0168986 A1 * 7/2010 Iwazaki ..... F02D 41/0085 701/103
2010/0318260 A1 * 12/2010 Ogiso ..... G01M 15/104 701/33.4
2010/0318282 A1 * 12/2010 Ogiso ..... F02D 41/1495 701/109
2010/0319667 A1 * 12/2010 Yoshikawa ..... F02D 41/1495 123/690
2010/0324802 A1 * 12/2010 Ogiso ..... F02D 41/1495 701/103
2012/0209497 A1 * 8/2012 Yoshikawa ..... F02D 41/0085 701/103
2012/0209498 A1 * 8/2012 Aoki ..... F02D 41/1486 701/103
2013/0118245 A1 * 5/2013 Yoshikawa ..... G01M 15/10 73/114.72
2013/0218442 A1 * 8/2013 Miyaji ..... F02D 41/1454 701/108
2013/0226437 A1 * 8/2013 Kato ..... F02D 41/1441 701/104
2014/0005882 A1 * 1/2014 Aoki ..... F02D 41/1441 701/33.1
2014/0288805 A1 * 9/2014 Fujime ..... F02D 41/3005 701/104
2014/0290219 A1 * 10/2014 Kato ..... F02D 41/1441 60/276
2014/0290348 A1 * 10/2014 Nakajima ..... G01M 15/102 73/114.75
2014/0305103 A1 * 10/2014 Nakagawa ..... F02D 41/1441 60/286
2015/0152804 A1 * 6/2015 Sakayanagi ..... F02D 41/2416 701/115
2016/0003181 A1 * 1/2016 Okada ..... F02D 41/1441 123/445
2016/0076474 A1 * 3/2016 Yoshikawa ..... F02D 41/1441 123/703

FOREIGN PATENT DOCUMENTS

JP 2009-074388 A 4/2009
JP 2009074388 A * 4/2009
JP 2009-203881 A 9/2009
JP 2012-017694 A 1/2012
JP 2014-190270 A 10/2014

* cited by examiner

AIR-FUEL RATIO CONTROL APPARATUS FOR INTERNAL COMBUSTION ENGINE

CROSS-REFERENCE TO RELATED APPLICATIONS

This is a national phase application based on the PCT International Patent Application No. PCT/JP2014/001818 filed Mar. 28, 2014, claiming priority to Japanese Patent Application No. 2013-088519 filed Apr. 19, 2013, the entire contents of both of which are incorporated herein by reference.

TECHNICAL FIELD

The present invention relates to an apparatus for controlling the air-fuel ratio of an internal combustion engine, and in particular, to an apparatus having a function to detect abnormality of a sensor for detecting an air-fuel ratio state based on an output value from the sensor and a function to determine air-fuel ratio imbalance among cylinders.

BACKGROUND ART

Internal combustion engines with an exhaust emission control system utilizing a catalyst generally control the mixture ratio of air to fuel in an air-fuel mixture combusted in the internal combustion engine, that is, the air-fuel ratio, in order to allow the catalyst to efficiently remove toxic components of exhaust gas for purification. The air-fuel ratio is typically detected by an air-fuel ratio sensor provided in an exhaust passage in the internal combustion engine and feedback-controlled by controlling the amount of fuel injection so as to make the air-fuel ratio equal to a predetermined target air-fuel ratio.

A typical configuration adopted to detect the air-fuel ratio includes an A/F sensor installed on an upstream side of an exhaust emission control catalyst to provide an output generally proportional to the air-fuel ratio and an $O_2$ sensor installed on a downstream side of the emission exhaust catalyst to provide an output that changes rapidly when the air-fuel ratio changes across a stoichiometric value. This configuration typically performs main feedback control controlling the fuel supply amount based on the output value from the A/F sensor so as to make the exhaust air-fuel ratio equal to the target air-fuel ratio and sub feedback control allowing correction of the fuel supply amount using a correction amount set based on the output value from the $O_2$ sensor. The purpose of performing the two types of feedback control is to use the output from the $O_2$ sensor to correct the output from the A/F sensor, the latter being likely to be erroneous as a result of insufficient mixture of exhaust gas or thermal degradation of a detection element.

Moreover, in order to reduce the amount of time needed for the sub feedback control utilizing the output from the $O_2$ sensor, a control method called learning control has been proposed which involves calculating and holding a learning value corresponding to a constant deviation between the output value from the $O_2$ sensor and the actual exhaust air-fuel ratio and correcting the fuel supply amount based on the learning value (see, for example, Patent Literature 1). The learning value of the learning control is, for example, calculated so as to incorporate at least a part of the correction amount of the sub feedback control. Such a configuration allows the output from the A/F sensor to be quickly corrected utilizing the learning value, for example, even immediately after the internal combustion engine is restarted, when the output from the A/F sensor has not been sufficiently corrected under the sub feedback control.

A possible failure such as element cracking in the $O_2$ sensor precludes appropriate detection from being continued, and is desirable to be detected on board. The $O_2$ sensor generally exhibits a low output in a lean atmosphere. However, possible element cracking results in a difference in gas concentration between an element inside area exposed to the outside air and an element outside area exposed to exhaust gas. Thus, the output voltage of the $O_2$ sensor decreases to provide an output apparently indicative of a lean state. Therefore, the sensor can be determined to be subjected to element cracking when, in spite of an increase in the amount of fuel injection, the output value from the $O_2$ sensor is leaner than a predetermined value lasts for more than a predetermined time (see, for example, Patent Literature 2). In order to suppress degradation of emission until the sensor is determined to be subjected to element cracking and during the period of retreat travelling following the determination, Patent Literature 2 further implements correction amount guard control allowing adjustment of the correction amount for air-fuel ratio control for the sub feedback control by setting a limit on the correction amount for the air-fuel ratio control according to the distribution of the output value from the $O_2$ sensor.

On the other hand, when, for example, a failure occurs in fuel injection systems for some cylinders to significantly vary the air-fuel ratio among the cylinders, the exhaust emission is disadvantageously degraded. Such a significant variation in air-fuel ratio as degrades the exhaust emission is desirably detected as abnormality. In particular, for automotive internal combustion engines, onboard detection of inter-cylinder air-fuel ratio imbalance has been demanded in order to prevent a vehicle with degraded exhaust emission from traveling. In recent years, attempts have been made to legally regulate the onboard detection of inter-cylinder air-fuel ratio imbalance.

To accomplish this purpose, various configurations have been proposed which detect inter-cylinder air-fuel ratio imbalance based on an output from an A/F sensor provided on the upstream side of a catalyst. For example, with focus placed on an extreme increase in the amount of hydrogen in exhaust observed when the air-fuel ratio shifts to a rich side in some cylinders and on removal of the hydrogen from the exhaust for purification using the catalyst, an apparatus described in Patent Literature 3 detects inter-cylinder air-fuel ratio imbalance based on the state of a deviation between a detection value from the A/F sensor provided on the upstream side of the catalyst and a detection value from an $O_2$ sensor provided on the downstream side of the catalyst. The configuration determines the presence of inter-cylinder air-fuel ratio imbalance when the detection value from the $O_2$ sensor deviates significantly toward a lean side with respect to the detection value from the A/F sensor.

CITATION LIST

Patent Literature

PTL 1: Japanese Patent Laid-Open No. 2012-017694
PTL 2: Japanese Patent Laid-Open No. 2005-036742
PTL 3: Japanese Patent Laid-Open No. 2009-203881

SUMMARY OF INVENTION

Technical Problem

As described above, the detection value from the $O_2$ sensor is indicative of the lean state both when element cracking occurs in the $O_2$ sensor and when inter-cylinder air-fuel ratio imbalance occurs. In this case, when the amount of fuel injection is increased in the above-described state, the state where the output value from the $O_2$ sensor is leaner than the predetermined value lasts for a predetermined time or longer when the element cracking is occurring in the $O_2$ sensor. In contrast, the increase in the amount of fuel injection causes a slight change in the output value from the $O_2$ sensor when inter-cylinder air-fuel ratio imbalance is occurring. This allows these two cases to be distinguished from each other. However, this distinction is difficult to carry out in a short time, and the emission may disadvantageously be degraded before the distinction is achieved.

Furthermore, in the apparatus implementing the correction amount guard control allowing adjustment of the correction amount for the air-fuel ratio control for the sub feedback control by setting a limit on the correction amount for the air-fuel ratio control, performing the correction amount guard control may lead to an insufficient correction amount for the air-fuel ratio, preventing the air-fuel ratio from being sufficiently shifted toward a rich state. This may prevent sufficient determination of inter-cylinder air-fuel ratio imbalance.

In view of the above-described circumstances, an object of the present invention is to accelerate the distinction between the case where element cracking occurs in the downstream sensor and the case where inter-cylinder air-fuel ratio imbalance occurs.

Solution to Problem

An aspect of the present invention provides an air-fuel ratio control apparatus including:

an upstream sensor provided on an upstream side of an exhaust emission control catalyst in an exhaust system of a multi-cylinder internal combustion engine and configured to detect an air-fuel ratio state based on an exhaust component, a downstream sensor provided on a downstream side of the exhaust emission control catalyst in the exhaust system and configured to detect the air-fuel ratio state based on the exhaust component; and a controller configured to control the internal combustion engine, the controller being programmed to perform:

main feedback control controlling a fuel supply amount so as to make an exhaust air-fuel ratio equal to a target air-fuel ratio based on an output value from the upstream sensor;

sub feedback control allowing correction of the fuel supply amount using a correction amount set based on an output value from the downstream sensor;

correction amount guard control allowing adjustment of the correction amount by setting a limit on the correction amount when an appearance frequency of a state where the output value from the downstream sensor is leaner than a predetermined value is equal to or higher than a predetermined value;

learning control allowing calculation of a learning value corresponding to a constant deviation between the output value from the upstream sensor and an actual exhaust air-fuel ratio in such a manner that the learning value incorporates at least a part of the correction amount and allowing correction of the fuel supply amount based on the calculated learning value;

sensor abnormality detection control allowing detection of abnormality in the downstream sensor based on the output value from the downstream sensor; and imbalance determination control allowing determination of air-fuel ratio imbalance among cylinders based on the output values from the upstream sensor and the downstream sensor, wherein the controller is further programmed to:

set an incorporation speed at which, during the learning control, the correction amount is incorporated into the learning value to a first speed when a state where the output value from the downstream sensor is leaner than the predetermined value lasts for a duration shorter than a predetermined time, and set the incorporation speed to a second speed higher than the first speed and suppress performance of the correction amount guard control until the learning control is completed, when the duration is equal to or longer than the predetermined time.

Preferably, the controller is further programmed to cancel suppression of performance of the correction amount guard control when the learning control is completed.

DESCRIPTION OF EMBODIMENTS

An embodiment of the present invention will be described based on the accompanying drawings.

Figure 1:
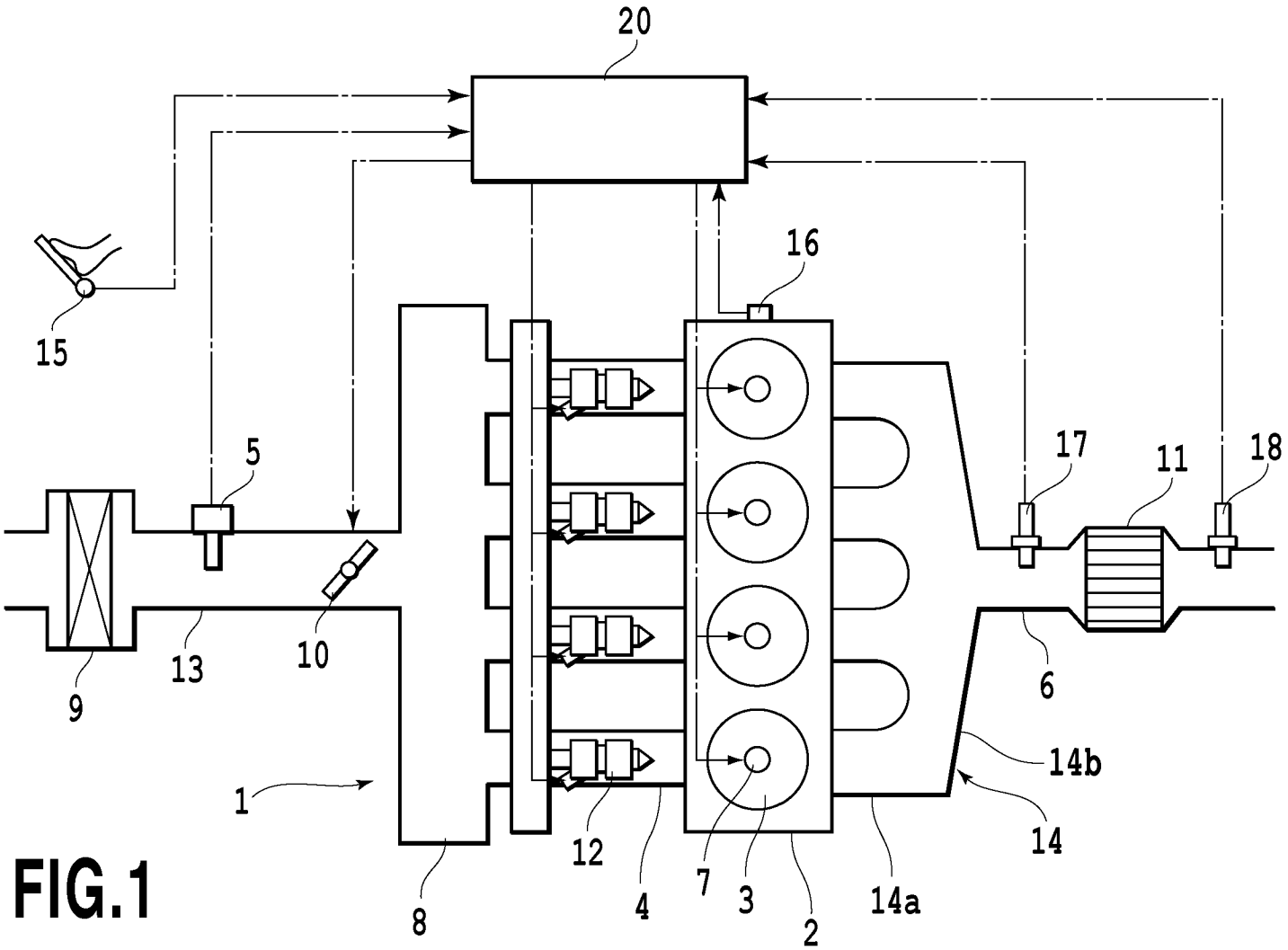
FIG. 1 is a schematic diagram of an internal combustion engine according to an embodiment of the present invention.

FIG. 1 is a schematic diagram of an internal combustion engine according to the present embodiment. As shown in FIG. 1, an internal combustion engine (engine) 1 combusts a mixture of fuel and air inside a combustion chamber 3 formed in a cylinder block and reciprocates a piston in the combustion chamber 3 to generate power. The internal combustion engine 1 according to the present embodiment is a multi-cylinder internal combustion engine mounted in a car, and more specifically, an inline four spark ignition internal combustion engine, that is, a gasoline engine. However, the internal combustion engine to which the present invention is applicable is not limited to the above-described engines. The number of cylinders, the type of the engine, and the like are not limited provided that the engine has a plurality of cylinders. An output shaft (not shown in the drawings) of the internal combustion engine 1 is connected to a torque converter, an automatic transmission, a differential gear assembly (none of which is shown in the drawings) to drive wheels. The automatic transmission is a stepped variable type but may be a continuously variable type.

Although not shown in the drawings, a cylinder head in the internal combustion engine 1 includes an intake valve and an exhaust valve both provided for each cylinder; the intake valve opens and closes an intake port and the exhaust valve opens and closes an exhaust port. The intake valve and the exhaust valve are opened and closed by a cam shaft or a solenoid actuator. Ignition plugs 7 are attached to a top portion of the cylinder head for the respective cylinders to ignite an air-fuel mixture in the combustion chamber 3.

The intake port of each cylinder is connected via a branch pipe 4 for the cylinder to a surge tank 8 serving as an intake collection chamber. An intake pipe 13 is connected to an upstream side of the surge tank 8 and to an air cleaner 9.

The intake pipe 13 incorporates an air flow meter 5 for detecting the amount of intake air (the amount of air sucked per unit time, that is, an intake flow rate), and an electronically controlled throttle valve 10. The intake ports, the branch pipes 4, the surge tank 8, and the intake pipe 13 form an intake passage.

Injectors (fuel injection valves) 12 are disposed for the respective cylinders to inject fuel into the intake passage, particularly into the respective intake ports. Fuel injected from the injector 12 is mixed with intake air to form an air-fuel mixture. When the exhaust valve is opened, the air-fuel mixture is sucked into the combustion chamber 3 and compressed by a piston. The compressed air-fuel mixture is ignited and combusted by the ignition plug 7.

On the other hand, the exhaust port of each cylinder is connected to an exhaust manifold 14. The exhaust manifold 14 includes branch pipes for the respective cylinders providing an upstream portion of the exhaust manifold 14 and an exhaust merging portion providing a downstream portion of the exhaust manifold 14. A downstream side of the exhaust merging portion is connected to the exhaust pipe 6. The exhaust ports, the exhaust manifold 14, and the exhaust pipe 6 form an exhaust passage.

A catalyst 11 including a three-way catalyst is mounted in the exhaust pipe 6. The catalyst 11 is formed of, for example, alumina with rare metal such as platinum (Pt), palladium (Ph), or rhodium (Rd) carried thereon. The catalyst 11 allows carbon oxide (CO), hydrocarbon (HC), and nitrogen oxide (NOx), and the like to be collectively removed for purification as a result of catalytic reaction.

An A/F sensor 17 is installed on an upstream side of the catalyst 11 and an $O_2$ sensor 18 is installed on a downstream side of the catalyst 11, in order to detect the air-fuel ratio of exhaust gas. The A/F sensor 17 is installed immediately in front of the catalyst 11 and the $O_2$ sensor 18 is installed immediately behind the catalyst 11. Both the A/F sensor 17 and the $O_2$ sensor 18 detect the air-fuel ratio based on the concentration of oxygen in the exhaust gas. The A/F sensor 17 corresponds to an upstream sensor according to the present invention. The $O_2$ sensor 18 corresponds to a downstream sensor according to the present invention.

The ignition plug 7, the throttle valve 10, the injector 12, and the like are electrically connected to an electronic control unit 20 (hereinafter referred to as an ECU) serving as a controller. The ECU 20 is a well-known one-chip microprocessor including a CPU, ROM, RAM, an I/O port, and a storage device (none of which is shown in the drawings).

As shown in FIG. 1, the ECU 20 electrically connects not only to the air flow meter 5, the A/F sensor 17, and the $O_2$ sensor 18, described above, but also to a crank angle sensor 16 that detects the crank angle of the internal combustion engine 1, an accelerator opening sensor 15 that detects an accelerator opening, and various other sensors, via A/D convertors or the like (not shown in the drawings).

Based on detection values from the various sensors and the like, the ECU 20 controls the ignition plugs 7, the throttle valve 10, the injectors 12, and the like, and ignition timings, throttle opening, the amount of fuel injection, fuel injection timings, transmission gear ratio, and the like so as to allow desired output to be obtained. The throttle opening is normally controlled to an appropriate value according to the accelerator opening.

Figure 2:
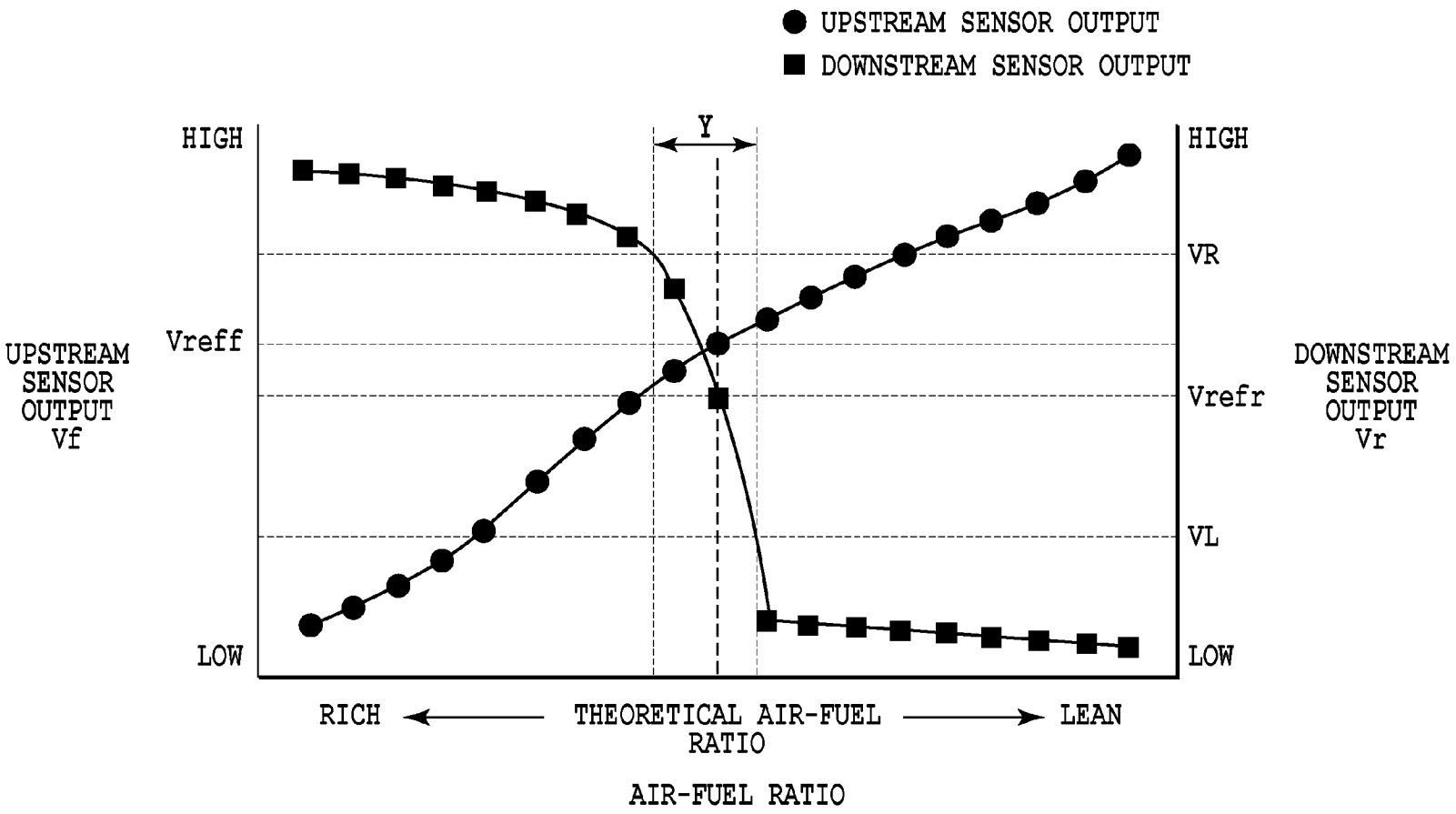
FIG. 2 is a graph showing output characteristics of an A/F sensor and an $O_2$ sensor.

The A/F sensor 17 includes what is called a wide-range air-fuel ratio sensor and can continuously detect a relatively wide range of air-fuel ratios. FIG. 2 shows the output characteristics of the upstream sensor, that is, the A/F sensor. As shown in FIG. 2, the A/F sensor 17 outputs a voltage signal Vf of a magnitude generally proportional to a detected air-fuel ratio. When the exhaust air-fuel ratio is stoichiometric (a theoretical air-fuel ratio, for example, A/F=14.6), an output voltage is equal to Vreff (for example, approximately 3.3 V).

On the other hand, the $O_2$ sensor 18 is characterized by having an output value changing rapidly when the air-fuel ratio changes across the stoichiometric value. FIG. 2 shows the output characteristics of the downstream sensor, that is, the $O_2$ sensor 18. As shown in FIG. 2, when the exhaust air-fuel ratio is stoichiometric, the output voltage, that is, a stoichiometrically equivalent value, is equal to Vreff (for example, 0.45 V). The output voltage from the $O_2$ sensor 18 changes within a predetermined range (for example, 0 (V) to 1 (V)). The output voltage from the $O_2$ sensor is lower than the stoichiometrically equivalent value Vreff when the exhaust air-fuel ratio is leaner than the stoichiometric ratio. The output voltage from the $O_2$ sensor is higher than the stoichiometrically equivalent value Vreff when the exhaust air-fuel ratio is richer than the stoichiometric ratio.

The catalyst 11 removes NOx, HC, and CO for purification at the same time when the air-fuel ratio A/F of incoming exhaust gas is close to the stoichiometric ratio. However, the range of the air-fuel ratio (window) within which these three substances can be efficiently removed for purification at the same time is relatively narrow.

The ECU 20 performs air-fuel ratio control (stoichiometric control) so as to control the air-fuel ratio of exhaust gas flowing into the catalyst 11 to the neighborhood of the stoichiometric ratio. The air-fuel ratio control includes main feedback control (main air-fuel ratio control) allowing the exhaust air-fuel ratio detected by the A/F sensor 17 to be made equal to the stoichiometric ratio, which is a predetermined target air-fuel ratio, and sub feedback control (supplementary air-fuel ratio control) allowing correction of the fuel supply amount using a correction amount set based on the output value from the $O_2$ sensor 18. The purpose of performing the two types of feedback control is to use the output from the $O_2$ sensor 18 to correct the output from the A/F sensor 17, which is likely to be erroneous as a result of thermal degradation of a detection element.

[Main Feedback Control]

The main feedback control will be specifically described below. First, according to the present embodiment, the amount of fuel to be fed from the fuel injection valve 12 to each cylinder (hereinafter referred to as the "target fuel supply amount") Qft(n) is calculated in accordance with Formula (1).

$$Qft(n)=Mc(n)/AFT+DQf(n-1) \quad (1)$$

Here, n denotes a value indicative of the number of calculations carried out by the ECU 20. For example, Qft(n) represents the target fuel supply amount resulting from the nth calculation (that is, obtained at time (n)). Mc(n) denotes the amount of air expected to be sucked into each cylinder before the intake valve is closed (hereinafter referred to as the "cylinder suction air amount"). The cylinder suction air amount Mc(n) is calculated using a map or a calculation formula based on an output from the air flow meter 5, a closing timing for the intake valve, or the like. AFT denotes a target value for the exhaust air-fuel ratio and corresponds to the theoretical air-fuel ratio of (14.7) according to the present embodiment. DQf denotes a fuel correction amount calculated in connection with the main feedback control described below. The fuel injection valve 12 allows injection of an amount of fuel corresponding to the target fuel supply amount calculated as described above.

Figure 3:
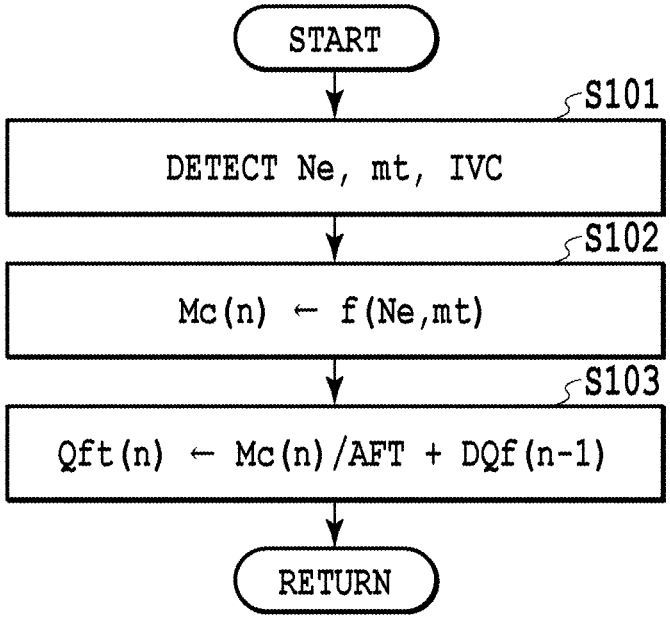
FIG. 3 is a flowchart showing a control routine for target fuel supply amount calculation control.

FIG. 3 is a flowchart showing a control routine for target fuel supply amount calculation control allowing calculation of the target fuel supply amount Qft (n) for fuel supplied through the fuel injection valve 12. The illustrated control routine is executed using interruptions at regular time intervals.

First, in step S101, the crank angle sensor 16, the air flow meter 5, and the like detect the number of engine rotations Ne, the flow rate of intake pipe passing air mt, and a closing timing for the intake valve IVC. Then, in step S102, the cylinder suction air amount Mc (n) at time (n) is calculated using a map or a calculation formula based on the number of engine rotations Ne, the flow rate of intake pipe passing air mt, and the close timing for the intake valve IVC all detected in step S101. Then, in step S103, the target fuel supply amount Qft (n) is calculated in accordance with Formula (1), described above, based on the cylinder suction air amount Mc(n) calculated in step S102 and the fuel correction amount DQf(n−1) at time (n−1) calculated under the main feedback control described below. The control routine is then ended. The fuel injection valve 12 allows an amount of fuel corresponding to the thus calculated target fuel supply amount Qft(n) to be injected.

Now, the main feedback control will be described. According to the present embodiment, the main feedback control involves calculating the amount of fuel deviation ΔQf between the actual fuel supply amount calculated based on the output from the A/F sensor 17 and the target fuel supply amount Qft, each time a calculation is carried out, and calculating the fuel correction amount DQf so that the amount of fuel deviation ΔGf becomes zero. Specifically, the fuel correction amount DQf is calculated in accordance with Formula (2). In Formula (2) shown below, DQf(n−1) denotes the fuel correction amount resulting from the n−1th calculation, that is, the last calculation, Kmp denotes a proportional gain, and Kmi denotes an integral gain. The proportional gain Kmp and the integral gain Kmi may be preset given values or values varying according to the state of engine operation.

$$DQf(n) = DQf(n-1) + Kmp \cdot \Delta Qf(n) + Kmi \cdot \sum_{k=1}^{n} \Delta Qf(k) \quad (2)$$

Figure 4:
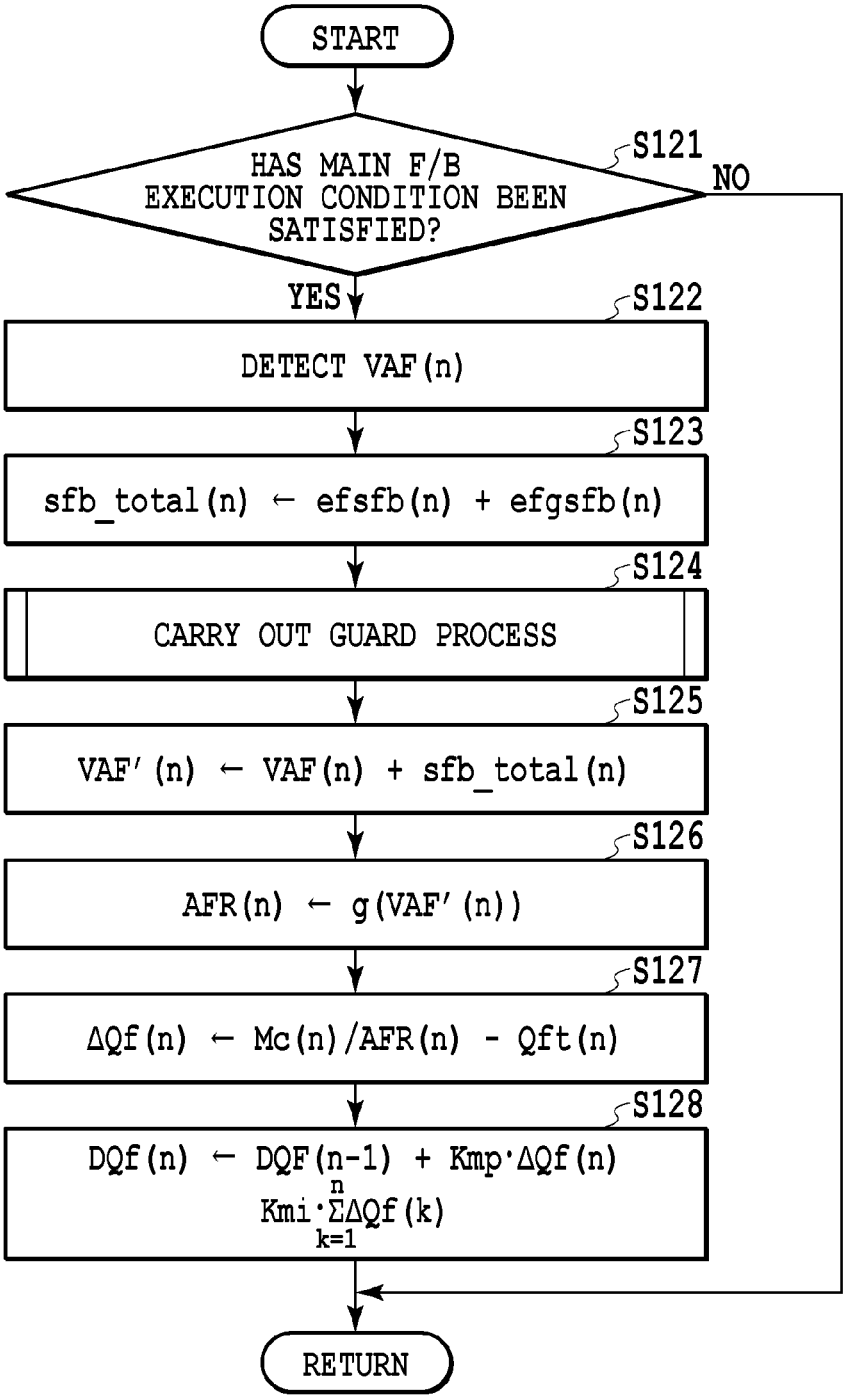
FIG. 4 is a flowchart showing a control routine for main feedback control allowing calculation of a fuel correction amount.

FIG. 4 is a flowchart showing a control routine for the main feedback control allowing calculation of the fuel correction amount DQf. The illustrated control routine is executed using interruptions at regular time intervals.

First, in step S121, the routine determines whether or not an execution condition for the main feedback control has been satisfied. The execution condition for the main feedback control has been satisfied if, for example, the following condition has been met: the internal combustion engine 1 is not performing a cold start (that is, the temperature of engine cooling water is equal to or higher than a given value and an engine start fuel increase and the like are not being carried out) or fuel cut control is not being performed which allows stoppage of fuel injection through the fuel injection valve 12 during engine operation. Upon determining in step S121 that the execution condition for the main feedback control has been satisfied, the routine proceeds to step S122.

In step S122, the output value VAF(n) from the A/F sensor 17 resulting from the nth calculation is detected. Then, in step S123, a sub feedback learning value efgfsb(n) described later is added to an output correction value efsfb(n) for the A/F sensor 17 calculated by a control routine for the sub feedback control described below to calculate a total correction amount sfb_total(n). Then, in step S124, a guard process is carried out as described later using the calculated total correction amount sfb_total(n).

Then, in step S125, the output value from the A/F sensor 17 is corrected using the total correction amount sfb_total(n) resulting from the guard process. Thus, a corrected output value VAF'(n) for the nth calculation is calculated (VAF'(n) =VAF(n)+sfb_total(n)).

Then, in step S126, an actual air-fuel ratio AFR(n) at time (n) is calculated using a map shown in FIG. 2 based on the corrected output value VAF'(n) calculated in step S125. The thus calculated actual air-fuel ratio AFR(n) is approximately equal to the actual air-fuel ratio of exhaust gas flowing into a three-way catalyst 20 which ratio results from the nth calculation.

Then, in step S127, the routine uses Formula (3) shown below to calculate the amount of fuel deviation ΔQf between the fuel supply amount calculated based on the output from the A/F sensor 17 and the target fuel supply amount Qft. In Formula (3), the values of the cylinder suction air amount Mc and the target fuel supply amount Qft result from the nth calculation but may result from a calculation before the nth calculation.

$$\Delta Qf(n)=Mc(n)/AFR(n)-Qft(n) \quad (3)$$

In step S128, the fuel correction amount DQf(n) at time (n) is calculated in accordance with Formula (2) described above, and the control routine is ended. The calculated fuel correction amount DQf(n) is used in step S103 of the control routine shown in FIG. 3. On the other hand, upon determining in step S121 that the execution condition for the main feedback control has not been satisfied, the control routine is ended, with update of the fuel correction amount DQf(n) omitted.

[Sub Feedback Control]

For example, the heat of exhaust gas may degrade the A/F sensor 17, causing the output from the A/F sensor 17 to deviate. Thus, the present embodiment performs the sub feedback control using the $O_2$ sensor 18, to compensate for a deviation in the output value from the A/F sensor 17 so that the output value from the A/F sensor 17 corresponds to the actual exhaust air-fuel ratio. That is, as shown in FIG. 2, the $O_2$ sensor 18 can determine whether the exhaust air-fuel ratio is richer or leaner than the theoretical air-fuel ratio, and is subjected to substantially no deviation in the determination of whether the exhaust air-fuel ratio is richer or leaner than the theoretical air-fuel ratio. Thus, the output voltage from the $O_2$ sensor 18 has a small value when the actual exhaust air-fuel ratio is indicative of a lean state and has a large value when the actual exhaust air-fuel ratio is indicative of a rich state. Thus, when the actual exhaust air-fuel ratio is approximately equal to the theoretical air-fuel ratio, that is, when the actual exhaust air-fuel ratio repeatedly increases and decreases near the theoretical air-fuel ratio, the output voltage from the $O_2$ sensor 18 repeats reversals between a large value and a small value. With the foregoing in view, the present embodiment corrects the output value from the A/F sensor 17 so that the output voltage from the $O_2$ sensor 18 repeats reversals between a large value and a small value.

Figure 5:
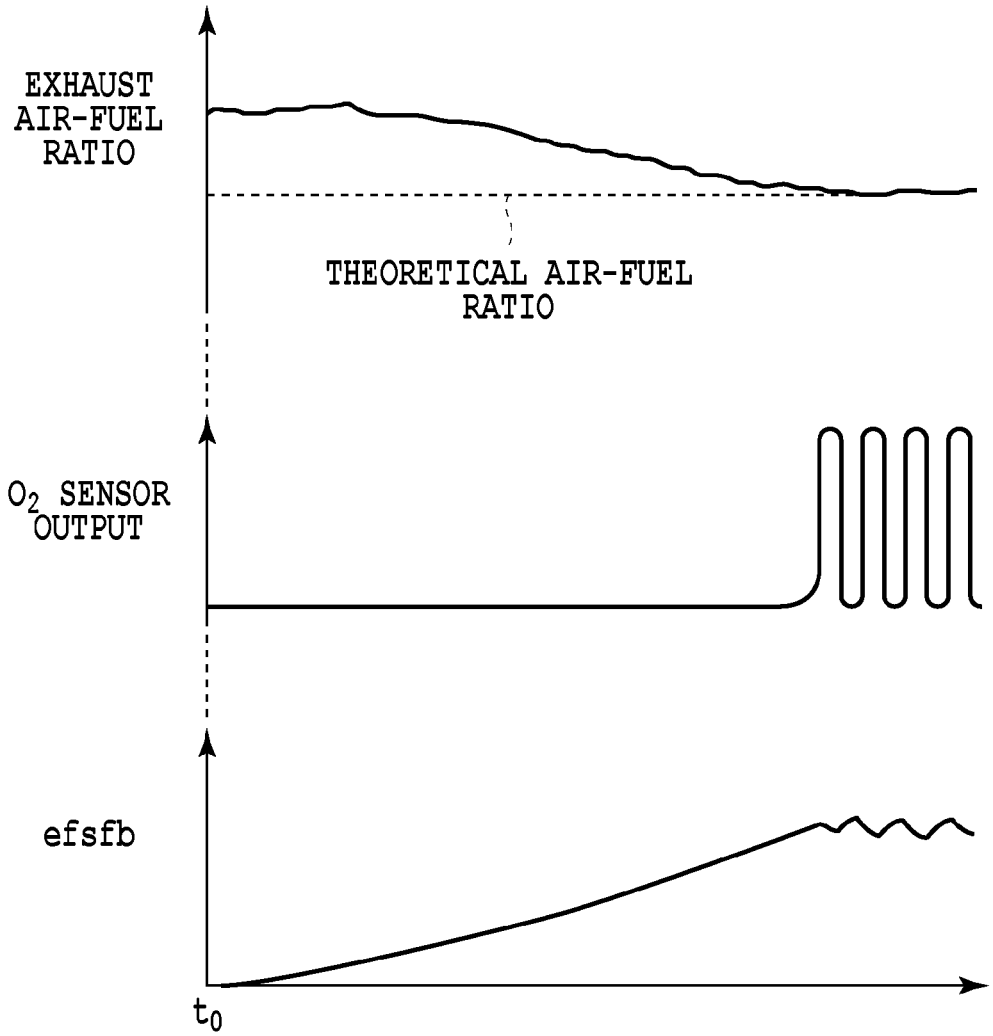
FIG. 5 is a time chart showing transition of an actual exhaust air-fuel ratio, an output value from an $O_2$ sensor, and an output correction value for the A/F sensor.

FIG. 5 is a time chart of the actual exhaust air-fuel ratio, the output value from the $O_2$ sensor 18, and the output correction values efsfb for the A/F sensor 17. A time chart in FIG. 5 shows how, when a deviation in the A/F sensor 17 prevents the actual air-fuel ratio from being made equal to the theoretical air-fuel ratio even though control is in execution to make the actual air-fuel ratio to equal to the theoretical air-fuel ratio, the deviation in the A/F sensor 17 is compensated for.

In an example illustrated in FIG. 5, at time t0, the actual exhaust air-fuel ratio is not equal to the theoretical air-fuel ratio but is leaner than the theoretical air-fuel ratio. This is because a deviation in the A/F sensor 17 causes the A/F sensor 17 to output an output value corresponding to the theoretical air-fuel ratio even though the actual exhaust air-fuel ratio is leaner than the theoretical air-fuel ratio. At this time, the $O_2$ sensor 18 provides a small output value.

The output correction value efsfb for the A/F sensor 17 is added to the output value VAF (n) in order to calculate the corrected output value VAF' (n) in step S125 in FIG. 4, as described above. Thus, the output value from the A/F sensor 17 is corrected to the lean side when the output correction value efsfb is positive and to the rich side when the output correction value efsfb is negative. The amount by which the output value from the A/F sensor 17 is corrected increases consistently with the absolute value of the output correction value efsfb.

When the output value from the $O_2$ sensor 18 is small even though the output value from the A/F sensor 17 is approximately equal to the theoretical air-fuel ratio, this means that the output value from the A/F sensor 17 is shifted toward the rich side. Thus, according to the present embodiment, when the output value from the $O_2$ sensor 18 is small, the output correction value efsfb is increased to correct the output value from the A/F sensor 17 toward the lean side as shown in FIG. 5. On the other hand, when the output value from the $O_2$ sensor 18 is large even though the output value from the A/F sensor 17 is approximately equal to the theoretical air-fuel ratio, the output correction value efsfb is reduced to correct the output value from the A/F sensor 17 toward the rich side.

Specifically, the output correction value efsfb is calculated in accordance with Formula (4) shown below. In Formula (4), efsfb(n−1) denotes the output correction value resulting from the n−1th calculation, that is, the last calculation, Ksp denotes a proportional gain, and Ksi denotes an integral gain. Furthermore, ΔVO(n) denotes an output deviation between the output value from the $O_2$ sensor 18 resulting from the nth calculation and the target output value (in the present embodiment, the value corresponding to the theoretical air-fuel ratio).

$$efsfb(n) = efsfb(n-1) + Ksp \cdot \Delta VO(n) + Ksi \cdot \sum_{k=1}^{n} \Delta VO(k) \tag{4}$$

As described above, in the example illustrated in FIG. 5, an increase in the output correction value efsfb for the A/F sensor 17 corrects the deviation in the output value from the A/F sensor 17. This makes the actual exhaust air-fuel ratio gradually closer to the theoretical air-fuel ratio.

Figure 6:
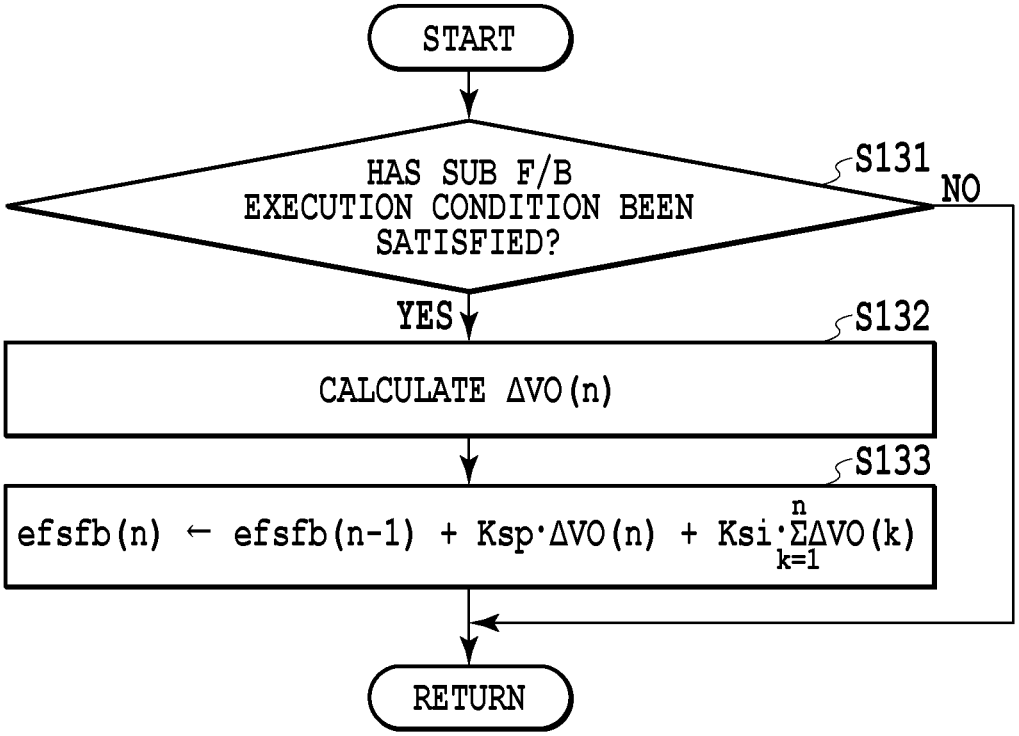
FIG. 6 is a flowchart showing a control routine for sub feedback control allowing calculation of the output correction value.

FIG. 6 is a flowchart showing a control routine for the sub feedback control allowing calculation of the output correction value efsfb. The illustrated control routine is executed using interruptions at regular time intervals.

First, in step S131, the routine determines whether or not an execution condition for the sub feedback control has been satisfied. The execution condition for the sub feedback control has been satisfied, for example, if the internal combustion engine is not performing a cold start or if fuel cut control is not being performed, as is the case with the execution condition for the main feedback control. Upon determining in step S131 that the execution condition for the sub feedback control has not been satisfied, the routine is ended.

On the other hand, upon determining that the execution condition for the sub feedback control has been satisfied, the routine proceeds to step S132. In step S132, an output deviation ΔVO(n) between the output value from the $O_2$ sensor 18 at time (n) and the target output value is calculated. In step S133, the output correction value efsfb(n) is calculated using Formula (4) described above based on the output deviation ΔVO calculated in step S132. The thus calculated output correction value efsfb(n) is used in step S125 shown in FIG. 4.

The above-described embodiment uses PI control as the main feedback control and the sub feedback control. However, the main feedback control and the sub feedback control may be performed using any other control method such as P control or PID control.

[Learning Control]

The present embodiment performs learning control in order to reduce the amount of time needed for the sub feedback control utilizing the output from the $O_2$ sensor. The learning control involves calculating and holding a learning value corresponding to a constant deviation between the output value from the $O_2$ sensor and the actual exhaust air-fuel ratio and correcting the fuel supply amount based on the learning value. The learning value is calculated so as to incorporate at least a part of the correction amount for the sub feedback control. The learning control allows the output from the A/F sensor to be quickly corrected by utilizing the learning value, for example, even immediately after the internal combustion engine is restarted, when the output value from the A/F sensor is not sufficiently corrected under the sub feedback control.

That is, the sub feedback control allows the output value from the A/F sensor 17 to be appropriately corrected but is discontinued, for example, when the internal combustion engine is stopped or when the fuel cut control is performed. As a result, the output correction value efsfb is reset to zero. Subsequently, for example, when the internal combustion engine is started again or the fuel cut control is ended, the sub feedback control is resumed. However, since the output correction value efsfb has been reset to zero, a long time is needed to correct the output value from the A/F sensor 17 to the appropriate value again.

Thus, the present embodiment involves calculating a sub F/B learning value efgsfb corresponding to a constant deviation between the output value from the A/F sensor 17 and the actual exhaust air-fuel ratio based on the output correction value efsfb for the sub feedback control, and correcting the output from the A/F sensor 17 based on the calculated sub F/B learning value efgsfb. In other words, the present embodiment performs learning control allowing at least a part of the output correction value efsfb to be incorporated into the sub F/B learning value efgsfb and allowing the output value VAF from the A/F sensor 17 to be corrected based on the sub F/B learning value efgsfb, so that the output correction value efsfb of the sub F/B control becomes small or essentially zero. The thus calculated sub F/B learning value efgsfb is inhibited from being reset to zero, for example, even when the internal combustion engine is stopped or when the fuel cut control is in execution. Hence, for example, even when the internal combustion engine is stopped or the fuel cut control is in execution, the output value from the A/F sensor 17 can be corrected to the appropriate value relatively early using the sub feedback control.

Figure 7:
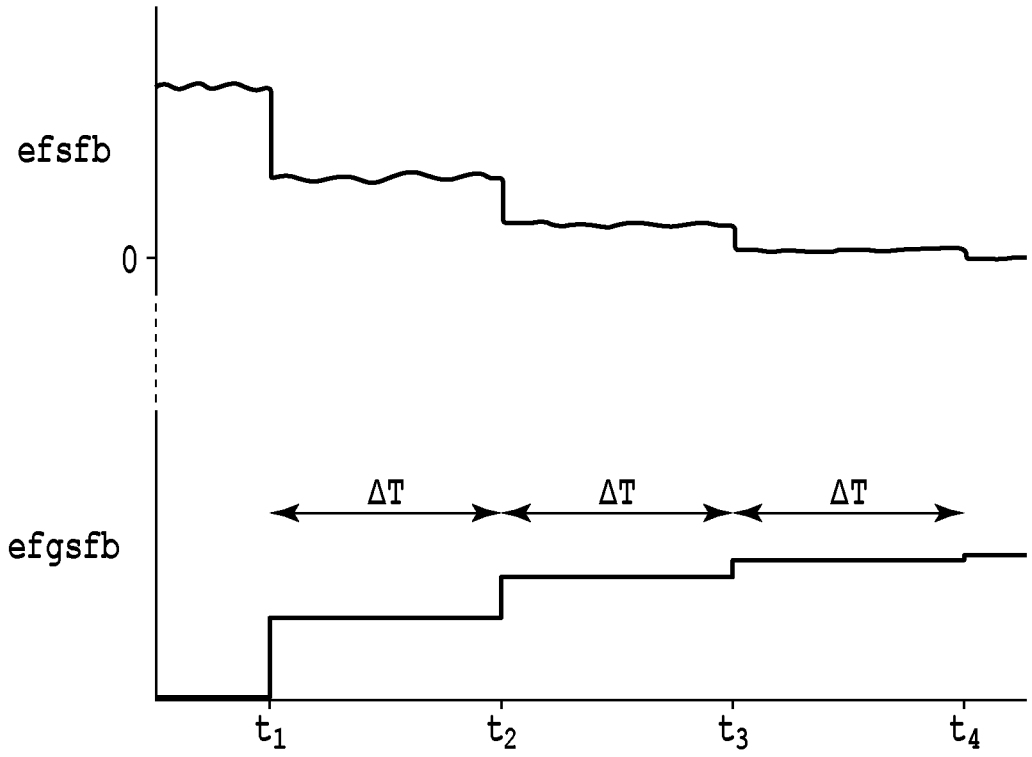
FIG. 7 is a time chart showing transition of an output correction value efsfb and a sub F/B learning value efgfsb during update of the sub F/B learning value.

FIG. 7 is a time chart of the output correction value efsfb and the sub F/B learning value efgsfb, showing a state when the sub F/B learning value efgsfb is updated. In an example illustrated in FIG. 7, when a learning value update condition is satisfied at time t1, update of the learning value is started. At time t1, when the learning value update condition is satisfied, the sub F/B learning value efgsfb is increased when the output correction value efsfb is positive, and reduced when the output correction value efsfb is negative. The amount by which the sub F/B learning value efgsfb is increased or reduced increases consistently with the absolute value of the output correction value efsfb.

In particular, according to the present embodiment, the output correction value efsfb is incorporated into the sub F/B learning value efgsfb at time t1 in accordance with Formulae (5) and (6) shown below. In Formulae (5) and (6), $\alpha$ denotes an incorporation rate that is a preset positive value of 1 or less ($0<\alpha\leq 1$). Thus, in an example illustrated in FIG. 6, the output correction value efsfb is positive at time t1. Thus, the output correction value efsfb is reduced, while the sub F/B learning value efgsfb is increased, in accordance with Formulae (5) and (6).

$$efsfb=efsfb-efsfb\cdot\alpha \quad (5)$$

$$efgfsb=efgfsb+efsfb\cdot\alpha \quad (6)$$

Subsequently, the output correction value efsfb and the sub F/B learning value efgsfb are modified, and then, at time t2, corresponding to elapse of an incorporation interval $\Delta T$ from time t1, an incorporation operation similar to the incorporation operation at time t1 is performed again. Such an incorporation operation for the output correction value efsfb and the sub F/B learning value efgsfb is repeated at the incorporation intervals $\Delta T$ (time t3 and time t4). Thus, the absolute value of the output correction value efsfb gradually decreases, and the absolute value of the sub F/B learning value efgsfb gradually increases. The sub F/B learning value efgsfb converges toward a certain value. When the sub F/B learning value efgsfb thus converges to the certain value, the update of the sub F/B learning value efgsfb is ended (time t4). The incorporation rate $\alpha$ and the incorporation interval $\Delta T$ as used herein are changed as necessary for a process of controlling a sub feedback learning speed described below.

Figure 8:
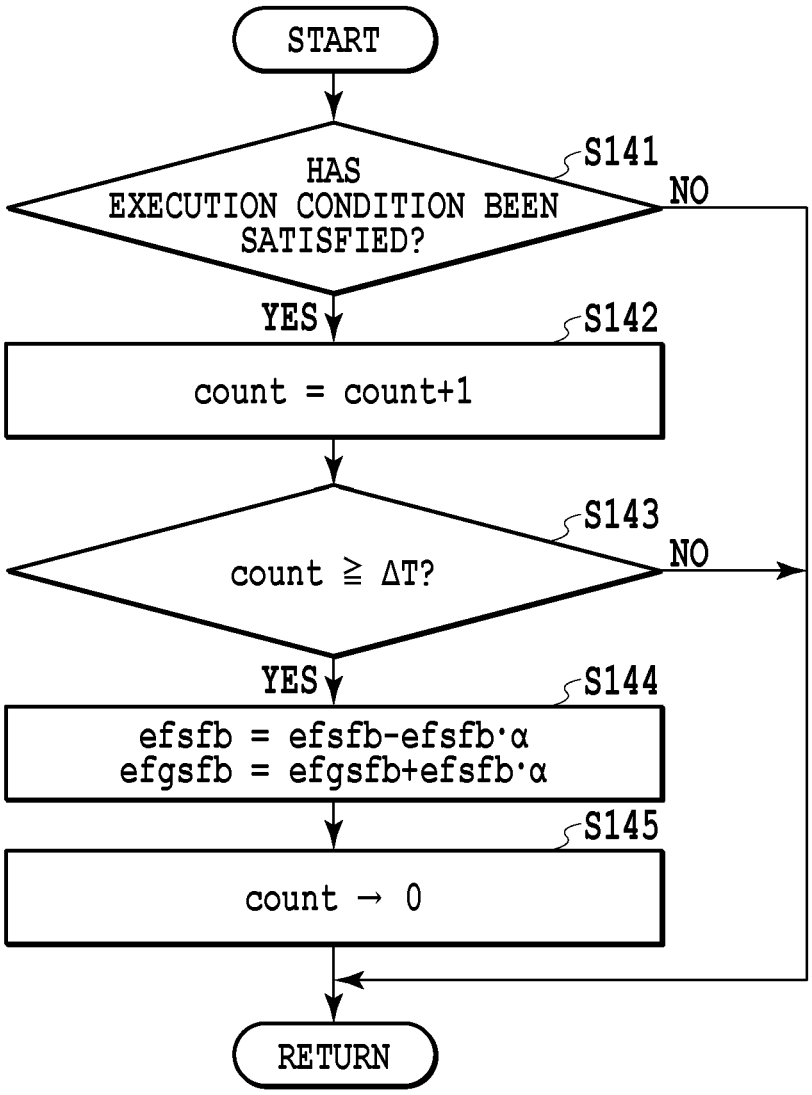
FIG. 8 is a flowchart showing a control routine for update of the sub F/B learning value efgfsb.

FIG. 8 is a flowchart showing a control routine for the update of the sub F/B learning value efgsfb. The illustrated control routine is executed using interruptions at regular time intervals.

As shown in FIG. 8, first, in step S141, the routine determines whether or not an execution condition for the sub feedback control has been satisfied. The execution condition for the sub feedback control has been satisfied, for example, if the engine is operating steadily, or if the internal combustion engine is not performing a cold start and the fuel cut control is not being performed.

Upon determining in step S141 that the execution condition for the sub feedback control has not been satisfied, the routine is ended. On the other hand, upon determining that the execution condition for the sub feedback control has been satisfied, the routine proceeds to step S142. In step S142, 1 is added to a time counter count to obtain a new value in the time counter count. The time counter count is a counter indicating an elapsed time from the last incorporation of the sub F/B learning value efgsfb.

Then, in step S143, the routine determines whether or not the time counter count is equal to or larger than a value corresponding to the incorporation interval $\Delta T$. When the value is smaller than the incorporation interval $\Delta T$, the control routine is ended. On the other hand, when the time counter count is determined to be equal to or larger than the incorporation interval $\Delta T$, the routine proceeds to step S144. In step S144, the output correction value efsfb is incorporated into the sub F/B learning value efgsfb based on Formulae (5) and (6). Then, in step S145, the time counter count is set to zero, and the control routine is ended.

[Correction Amount Guard Control]

The present embodiment performs correction amount guard control allowing the correction amount for the air-fuel ratio control to be adjusted by setting a limit on the correction amount for the sub feedback control according to the distribution of the output value from the $O_2$ sensor 18. As described above, when element cracking occurs in the $O_2$ sensor, the output voltage from the $O_2$ sensor decreases, and the output from the $O_2$ sensor resembles the lean state. Thus, performing the sub feedback control utilizing the output from the $O_2$ sensor leads to an excessive increase (richer state) in fuel concentration. Such element cracking can be detected based on "the lasting, for a predetermined time or longer, of the state in which the output value from the $O_2$ sensor is leaner than the predetermined value in spite of an increase in the amount of fuel injection". However, the emission may be degraded before this detection is carried out or during the period of retreat traveling from execution of the detection until replacement of the $O_2$ sensor. Thus, such an excessive increase in fuel concentration is desirably suppressed. To achieve this, the present embodiment implements the correction amount guard control allowing a limit to be set on the correction amount for the sub feedback control for the air-fuel ratio control according to the distribution of the output value from the $O_2$ sensor 18.

Figure 9:
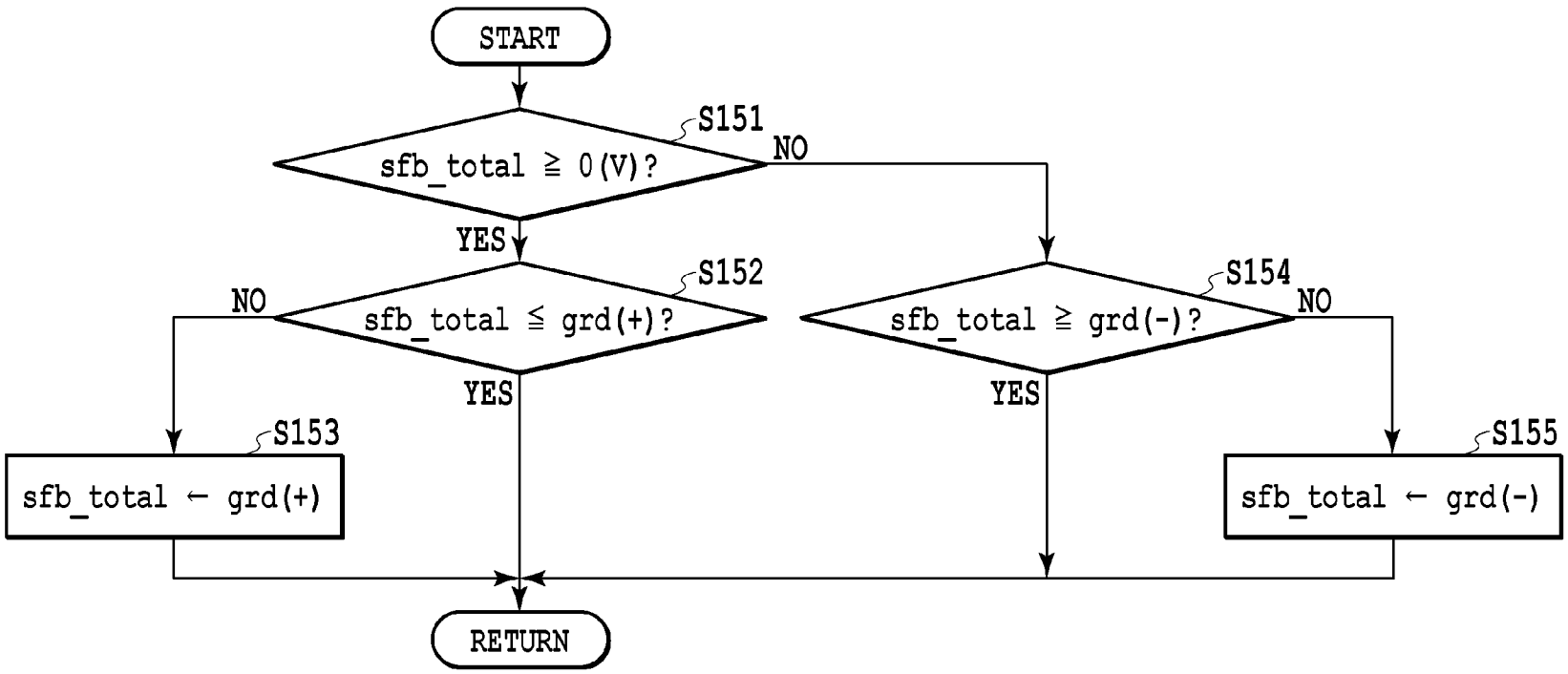
FIG. 9 is a flowchart showing a control routine for a guard process for the output correction value efsfb.

FIG. 9 is a flowchart showing a control routine for a guard process for the output correction value efsfb. First, the routine determines whether or not a total correction amount sfb_total that is the total value of the correction amount efsfb and the sub feedback learning value efgsfb is equal to or larger than "0 (V)" (S151). When the total correction amount sfb_total≥0 (YES in S151), the routine determines whether or not the total correction amount sfb_total≤grd(+) (S152). In this case, the plus side guard value grd(+) is an upper limit value set for a process of setting a guard value described later.

When the total correction amount sfb_total≤grd(+) ("YES" in S152), the guard process is temporarily ended without changing the total correction amount sfb_total. However, when the total correction amount sfb_total>grd(+) ("NO" in S152), the value of the total correction amount sfb_total is changed to the plus side guard value grd(+) (S153). This allows the value of the total correction amount sfb_total to be limited using the plus side guard value grd(+) as an upper limit. Thus, the guard process is temporarily ended.

On the other hand, when the total correction amount sfb_total<0 ("NO" in S151), the routine determines whether or not the total correction amount sfb_total grd(−) (S154). In this case, a minus side guard value grd(−) is a lower limit value set for the process of setting the guard value described later.

When the total correction amount sfb_total≥grd(−) ("YES" in S154), the guard process is temporarily ended without changing the total correction amount sfb_total. However, when the total correction amount sfb_total<grd(+) ("NO" in S154), the value of the total correction amount sfb_total is changed to the minus side guard value grd(−) (S155). This allows the value of the total correction amount sfb_total to be limited using the minus side guard value grd (−) as a lower limit. Thus, the guard process is temporarily ended.

When such a guard process is ended, the processing returns to step S125 in FIG. 4 described above. The output voltage VAF (n) from the A/F sensor 17 is corrected using the total value of the correction amount efsfb and the sub feedback learning value efgsfb. Thus, the controlling voltage value VAF' (n) is calculated (S125).

Figure 10:
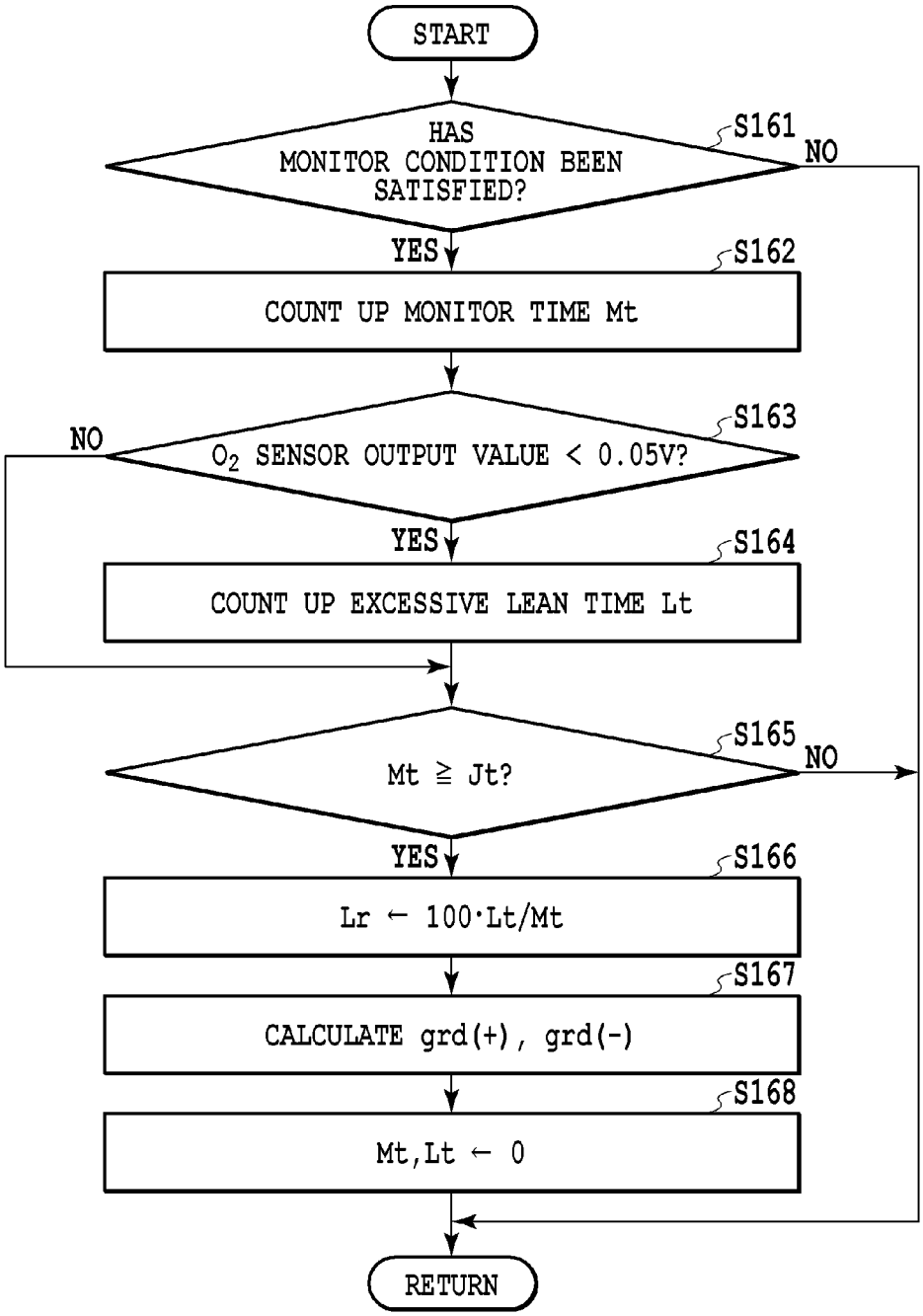
FIG. 10 is a flowchart showing a control routine for a process of setting a guard value.

FIG. 10 is a flowchart showing a control routine for the process of setting the guard value. The process is repeatedly carried at a constant time period. When the process is started, the routine determines whether or not a monitor condition has been satisfied (S161). The monitor condition referred to here is a condition under which abnormality in the output from the $O_2$ sensor 18 can be determined using the output value from the $O_2$ sensor 18 itself. Examples of the condition are as follows: "(1) activation of the $O_2$ sensor is complete, (2) the sub air-fuel ratio feedback control is in execution (steps S104 to S110 in FIG. 4 described above are in execution), (3) a specified time has elapsed since recovery from fuel cut, (4) the amount of intake air GA is equal to or larger than a specified value, (5) the engine is not idle, and (6) a sub feedback learning acceleration request flag is off". (3) is used as the condition because, after recovery from fuel cut, the routine needs to wait until the adverse effect of the fuel cut is eliminated. (4) and (5) are used as the condition because the back pressure of exhaust needs to be sufficiently increased in order to allow the output from the $O_2$ sensor 18 to clearly indicate that element cracking is occurring in the $O_2$ sensor 18.

When the monitor condition has been satisfied ("YES" in S161), a monitor time Mt is then counted up (S162). The monitor time Mt is set to "0" during initialization when the ECU 20 is started up. This serves as a timer counter for counting a total elapsed time when the monitor condition is satisfied.

Then, the routine determines whether or not the output value from the $O_2$ sensor 18 is smaller than 0.5 V (S163).

If the $O_2$ sensor 18 is normal, then during the sub air-fuel ratio feedback control, the output value appears at an approximately equivalent frequency on a low voltage side and on a high voltage side across a voltage of 0.45 V. The output value appears very infrequently in a very lean region of 0 V≤Vo2<0.05 V.

When initial element cracking causes exhaust gas to leak toward an atmospheric side of the $O_2$ sensor 18, the slight leakage of exhaust shifts the output value Vo2 from the $O_2$ sensor 18 toward the lean side so that the appearance frequency of the output value increases rapidly in the region of 0 V≤Vo2<0.05 V.

When the element cracking progresses to cause more exhaust gas to leak toward the atmospheric side of the $O_2$ sensor 18, the output value from the $O_2$ sensor 18 appears only on the lean side, and very frequently in the region of 0V≤Vo2<0.05 V.

Thus, the adverse effect of the element cracking clearly appears as the frequency of the appearance of the output valueVo2 from the $O_2$ sensor 18 in the region of 0 V≤Vo2<0.05 V. Determination of whether or not Vo2<0.05 V is for determining the frequency of the appearance in this region.

When Vo2<0.05 V ("YES" in S163), an excessive lean time Lt is counted up (S164). The excessive lean time Lt is set to "0" during initialization when the ECU 20 is started up. This serves as a timer counter for counting a total elapsed time when 0 V≤Vo2<0.05 V.

After step S164 or upon determining that Vo2≥0.05 V ("NO" in S163), the routine determines whether or not the monitor time Mt is equal to or longer than a monitor reference time Jt (S165). Then, when Mt<Jt ("NO" in S165), the process is temporarily ended.

The above-described process is repeated, and when the monitor time Mt≥Jt ("YES" in S165), the frequency of appearance Lr (%) in 0 V≤Vo2<0.05 V during the monitor time Mt is calculated (S166).

$$Lr \leftarrow 100 \cdot Lt/Mt \tag{7}$$

When the appearance frequency Lr exceeds a predetermined threshold, the above-described guard values grd(+) and grd(−) are set. The guard values grd(+) and grd(−) may be fixed or may vary according to the appearance frequency Lr.

When the calculation of the guard values grd(+) and grd(−) thus ends, the monitor time Mt and the excessive lean time Lt are then cleared (S168), and the process is temporarily ended. Thus, the above-described process is repeated, which involves determining the appearance frequency Lr during the monitor time Mt and setting the guard values grd(+) and grd(−).

[Inter-Cylinder Air-Fuel Ratio Imbalance Detection Control]

Figure 11:
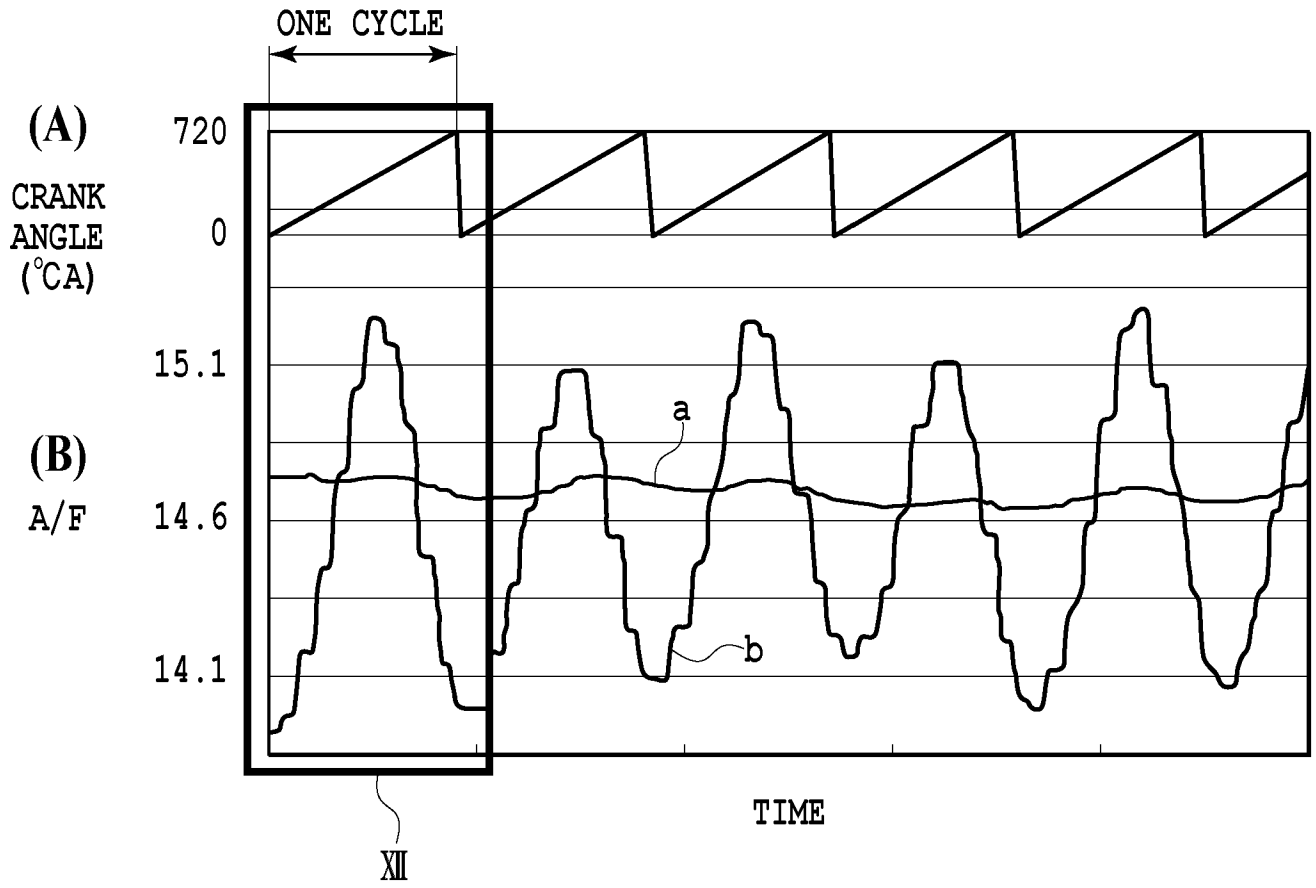
FIG. 11 is a graph showing a fluctuation in air-fuel ratio sensor output observed when the air-fuel ratio is not varying among cylinders (diagram (a)) and when the air-fuel ratio is varying among the cylinders (diagram (b))

The present embodiment implements control allowing inter-cylinder air-fuel ratio imbalance to be detected based on the outputs from the A/F sensor 17 and the $O_2$ sensor 18. As shown in FIG. 11, the exhaust air-fuel ratio A/F detected by the A/F sensor 17 tends to vary cyclically at a period equal to one engine cycle (=720° CA). A variation in inter-cylinder air-fuel ratio increases a fluctuation in exhaust air-fuel ratio within one engine cycle. In FIG. 11(B), an air-fuel ratio diagram (a) shows that the air-fuel ratio is not varying among the cylinders and an air-fuel ratio diagram (b) shows that the air-fuel ratio is varying among the cylinders. FIG. 11 is schematically illustrated for easy understanding.

Here, an imbalance rate (%) is a parameter representing the degree of a variation in inter-cylinder air-fuel ratio. That is, the imbalance rate is a value indicative of, when only one of all the cylinders is subjected to a deviation in the amount of fuel injection, how much the amount of fuel injection in the cylinder with a deviation (imbalanced cylinder) deviates from the amount of fuel injection in the cylinders with no deviation (balanced cylinder). When the imbalance rate is denoted by IB, the amount of fuel injection in the imbalanced cylinder is denoted by Qib, and the amount of fuel injection in the balanced cylinders, that is, the reference amount of fuel injection, is denoted by Qs, then IB=(Qib−Qs)/Qs. An increase in imbalance rate IB increases the deviation of the amount of fuel injection in the imbalanced cylinder from the amount of fuel injection in the balanced cylinders, and increases the degree of a variation in air-fuel ratio.

As is understood from the above description, possible air-fuel ratio imbalance increases a fluctuation in the output from the A/F sensor. Thus, monitoring the degree of the fluctuation enables air-fuel ratio imbalance to be detected. The present embodiment involves calculating a fluctuation parameter, that is a parameter correlated with the degree of a fluctuation in A/F sensor output, and comparing the fluctuation parameter with a predetermined abnormality determination value to detect imbalance.

Figure 12:
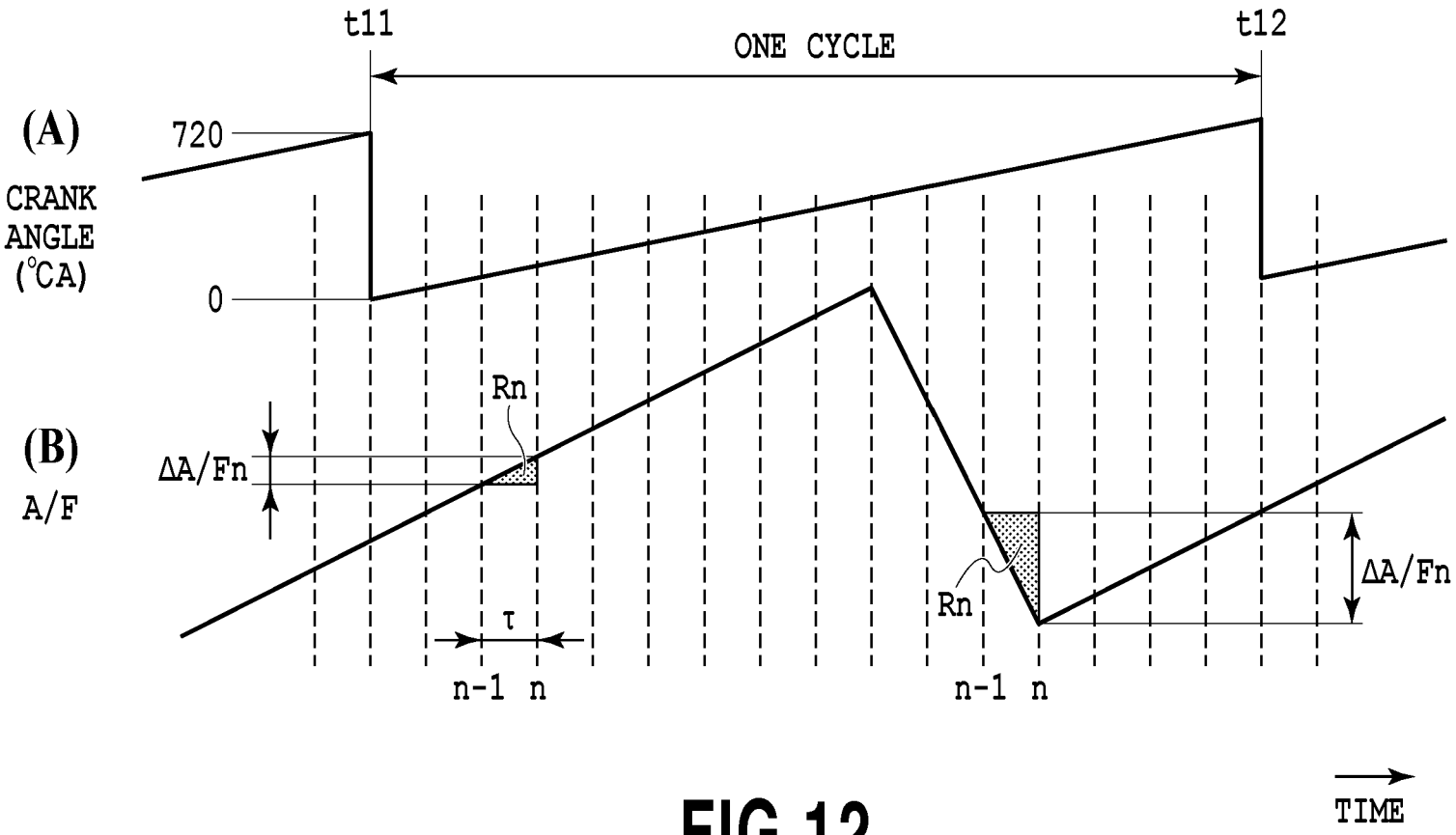
FIG. 12 is an enlarged diagram corresponding to an XII portion of FIG. 11.

Now, a method for calculating the fluctuation parameter will be described. FIG. 12 is an enlarged view corresponding to a portion XII of FIG. 11 and particularly showing a fluctuation in A/F sensor output within one engine cycle. In this case, the A/F sensor output is a value resulting from a conversion of the output voltage Vf from the A/F sensor 17 into the air-fuel ratio A/F. However, the output voltage Vf from the A/F sensor 17 may be directly used.

As shown in FIG. 12(B), the ECU 20 acquires the value of the A/F sensor output A/F at every sample period τ (unit time, for example, 4 ms) during one engine cycle. The ECU 20 then determines a difference ΔA/Fn between a value A/Fn acquired at the current timing (second timing) with a value A/Fn−1 acquired at the last timing (first timing), in accordance with Formula (8) shown below. The difference ΔA/Fn may be referred to as a differential value or slope at the current timing.

$$\Delta A/F_n = A/F_n - A/F_{n-1} \quad (8)$$

Most simply stated, the difference Δ A/Fn denotes a fluctuation in A/F sensor output. This is because an increase in the degree of fluctuation increases the absolute value of the slope on the air-fuel ratio diagram and also increases the absolute value of the difference ΔA/Fn. Thus, the fluctuation parameter may be the value of the difference ΔA/Fn at one predetermined timing.

However, the present embodiment uses the average value of a plurality of differences ΔA/Fn as the fluctuation parameter in order to improve accuracy. According to the present embodiment, the differences ΔA/Fn obtained within one engine cycle are integrated at every timing, and the final integrated value is divided by the number of samples N to determine the average of the difference ΔA/Fn within one engine cycle. Moreover, the average values of the difference ΔA/Fn obtained over M engine cycles (for example, M=100) are integrated, and the final integrated value is divided by the number of the cycles M to determine the average value of the difference ΔA/Fn within M engine cycles.

An increase in the degree of fluctuation in A/F sensor output increases the absolute value of the average value of the difference ΔA/Fn within M engine cycles. Thus, when the absolute value of the average value is equal to or larger than a predetermined abnormality determination value, the routine determines that imbalance is present. When the average value is smaller than the abnormality determination value, the routine determines that no imbalance is present, that is, the engine is normal.

The A/F sensor output A/F may increase or decrease, and thus, the fluctuation parameter may be the difference ΔA/F or the average value thereof determined for only one of these cases. In particular, if only one cylinder is shifted toward the rich side, the output from the A/F sensor changes rapidly toward the rich side (that is, decreases rapidly). Thus, it is possible that only the decrease side value is used to detect a rich shift (rich imbalance determination). In this case, only a downward sloping area in the graph in FIG. 6(B) is utilized for rich shift detection. In general, a shift from lean state to rich state is more rapid than a shift from rich state to lean state. Thus, the method of using only the decrease side value is expected to allow a rich shift to be accurately detected. Of course, the present invention is not limited to this method, but it is possible that only the increase side value is used or that both the decrease side value and the increase side value are used (in this case, the absolute values of the difference ΔA/Fn are integrated and the integrated value is compared with a threshold).

Furthermore, any value correlated with the degree of fluctuation in A/F sensor output may be used as the fluctuation parameter. For example, the fluctuation parameter may be calculated based on the difference between the maximum value and minimum value of the A/F sensor output within one engine cycle (what is called, peak to peak). This is because the difference increases consistently with the degree of fluctuation in A/F sensor output.

Figure 13:
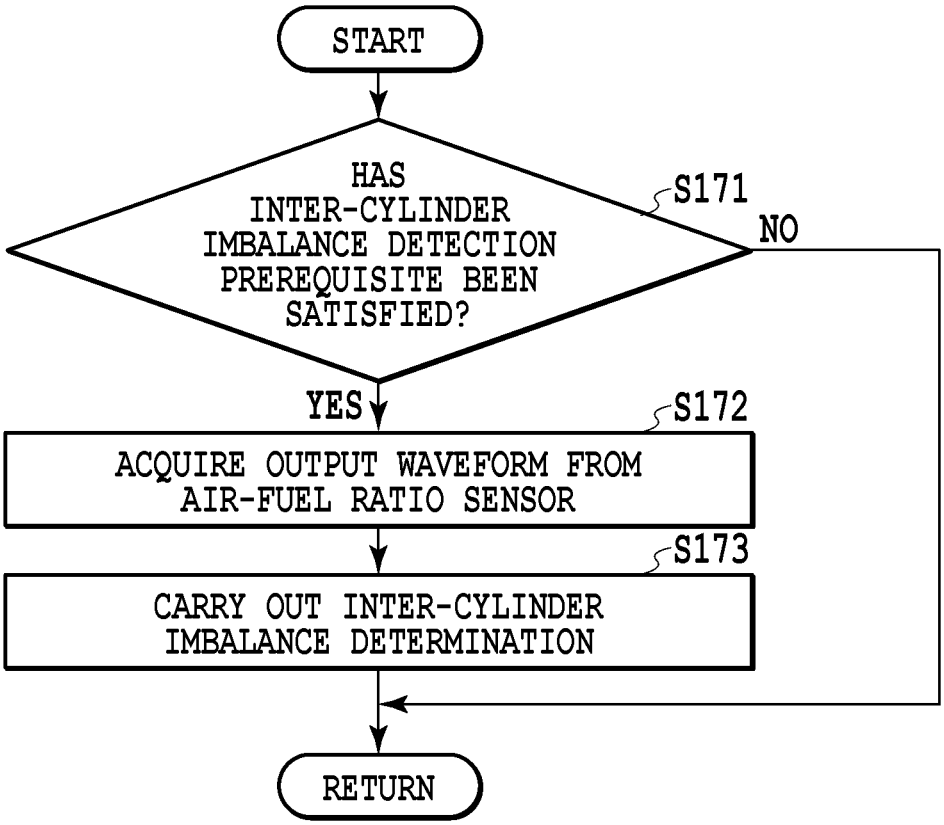
FIG. 13 is a flowchart showing a control routine for a process of detecting inter-cylinder air-fuel ratio imbalance.

Now, a control routine for a process of detecting inter-cylinder air-fuel ratio imbalance will be described with reference to FIG. 13.

First, in step S171, the routine determines whether or not a predetermined prerequisite suitable for detecting inter-cylinder air-fuel ratio imbalance has been satisfied. The prerequisite is satisfied when each of the following condition is satisfied.

(1) Warm-up of the internal combustion engine 1 has ended. The warm-up is determined to have ended when a water temperature detected by a water temperature sensor 23 is equal to or higher than a predetermined value.

(2) At least the A/F sensor 17 has been activated.

(3) The internal combustion engine 1 is operating steadily.

(4) Stoichiometric control is in execution.

(5) The internal combustion engine 1 is operating within a detection region.

(6) The output A/F from the A/F sensor 17 is on the decrease.

(6) indicates that the routine depends on the rich imbalance determination (the method of using only the decrease side value for rich shift detection). The routine is ended when the prerequisite has not been satisfied.

When the prerequisite has been satisfied, the ECU 20 then detects an air-fuel ratio fluctuation based on the output from the A/F sensor 17 (S172). In this case, the output A/Fn from the A/F sensor 17 (first air-fuel ratio sensor) at the current timing is acquired, and the output difference ΔA/Fn at the current timing is calculated in accordance with Formula (8), described above, and stored. Then, the above-described process is repeatedly carried out until the process is completed for M cycles (M is any natural number). When M cycles end, the average value of the calculated output difference ΔA/Fn is calculated, for example, by dividing the integrated value of the difference ΔA/Fn by the number of samples N and then by the number of engine cycles M as described above. The average value ΔA/FAV represents the air-fuel ratio fluctuation.

Then, imbalance determination is carried out based on the detected air-fuel ratio fluctuation (S173). Specifically, the routine determines whether the absolute value of the average value Δ A/FAV of the difference ΔA/Fn is larger than a preset abnormality threshold β. When the absolute value of the average value Δ A/FAV is smaller than the abnormality threshold β, the routine determines that no imbalance is present, that is, the engine is normal. When the absolute value of the average value Δ A/FAV is equal to or larger than the abnormality threshold β, the routine determines that imbalance is present, that is, the engine is abnormal, and the routine is ended. Preferably, simultaneously with an abnormality determination or when an abnormality determination is made during two consecutive trips (two consecutive trips each from engine start to engine stop), a warning device such as a check lamp is turned on to inform a user of the abnormality and abnormality information is stored in a predetermined diagnosis memory so as to enable a mechanic to call the information.

[$O_2$ Sensor Abnormality Determination Control]

The present embodiment implements $O_2$ sensor abnormality determination control allowing abnormality in the $O_2$ sensor 18 to be determined. The abnormality determination control allows the ECU 20 to determine abnormality in the $O_2$ sensor when the output voltage from the $O_2$ sensor 18 is significantly shifted toward the lean state (for example, lower than 0.05 mV) even though the learning value in the above-described learning control is equal to or larger than a predetermined value (for example, 200 mV or higher). Preferably, as is the case with the inter-cylinder air-fuel ratio imbalance determination, simultaneously with a determination of abnormality in the $O_2$ sensor 18 or when an abnormality determination is made during two consecutive trips (two consecutive trips each from engine start to engine stop), a warning device such as a check lamp is turned on to inform a user of the abnormality and abnormality information is stored in the predetermined diagnosis memory so as to enable a mechanic to call the information.

[Process of Controlling the Sub Feedback Learning Speed]

Figure 14:
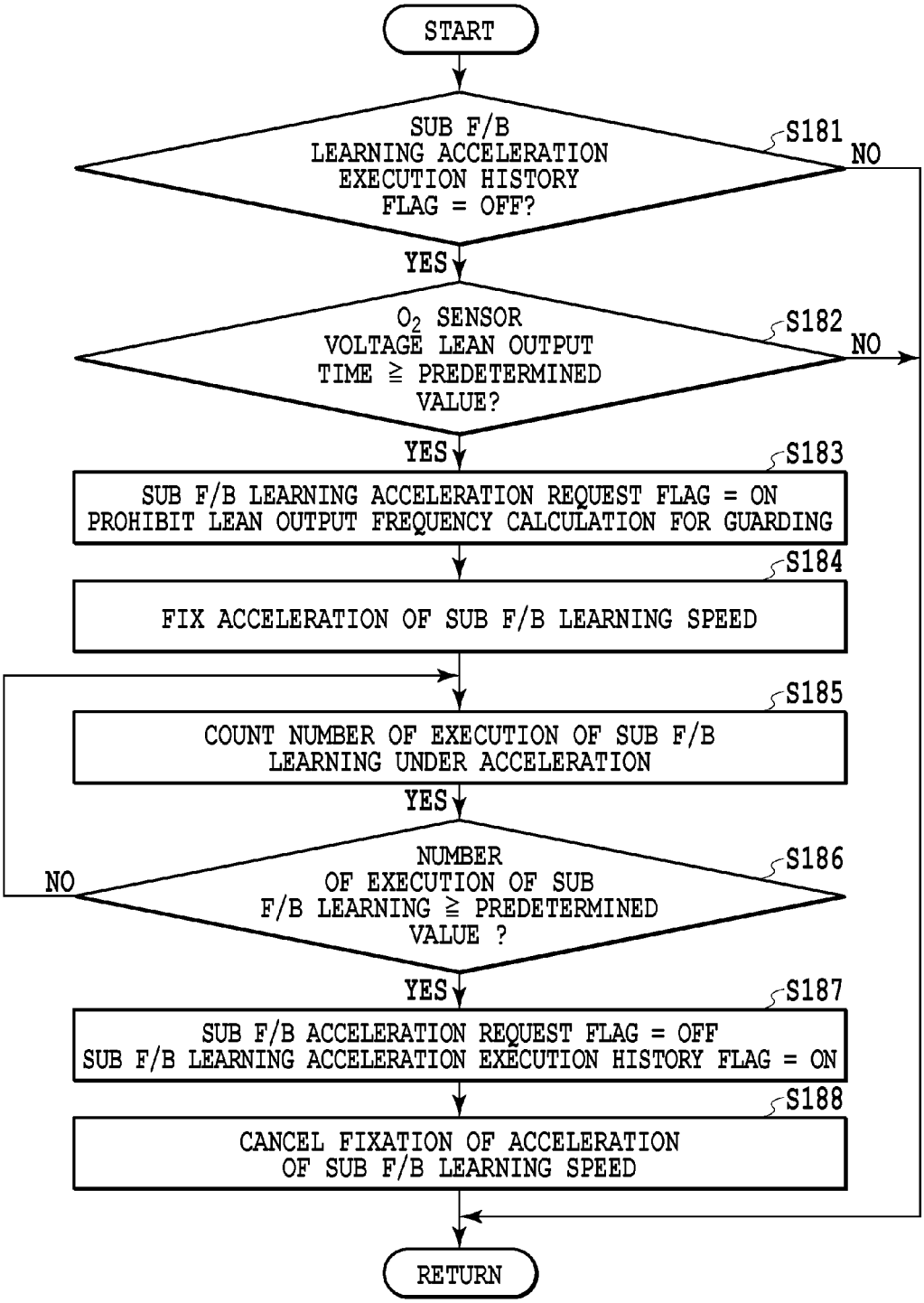
FIG. 14 is a flowchart showing a control routine for a process of controlling a sub feedback learning speed.

A process of controlling a sub feedback learning speed according to the present embodiment configured as described above will be described below. FIG. 14 shows a control routine for controlling the sub feedback learning speed. First, the ECU 20 determines whether a sub feedback learning acceleration execution history flag is on (S181). When the determination is negative, the process is returned. However, the flag is initially off, and thus, the determination is affirmative this time.

Then, the ECU 20 determines whether the duration of the state where the $O_2$ sensor 18 exhibits a lean output (for example, 0.5 mV or lower) lasts for a predetermined value (for example, 5 seconds to 10 seconds) or larger (S182). If neither element cracking in the $O_2$ sensor 18 nor inter-cylinder air-fuel ratio imbalance occurs, such a lean output does not normally last for a long time. Thus, in this case, the determination is negative and the process is returned.

When the determination in step S182 is affirmative, that is, when the duration of the lean output from the $O_2$ sensor 18 lasts for the predetermined time or larger, a sub feedback learning acceleration request is turned on (S183). The sub feedback learning acceleration request flag indicates that a sub feedback learning acceleration request has been issued and that accelerated sub feedback learning is not complete. When the flag is on, the monitor condition for the above-described process of setting the guard value (FIG. 10) fails to be satisfied. Thus, the process of setting the guard value is prohibited.

Figure 15:
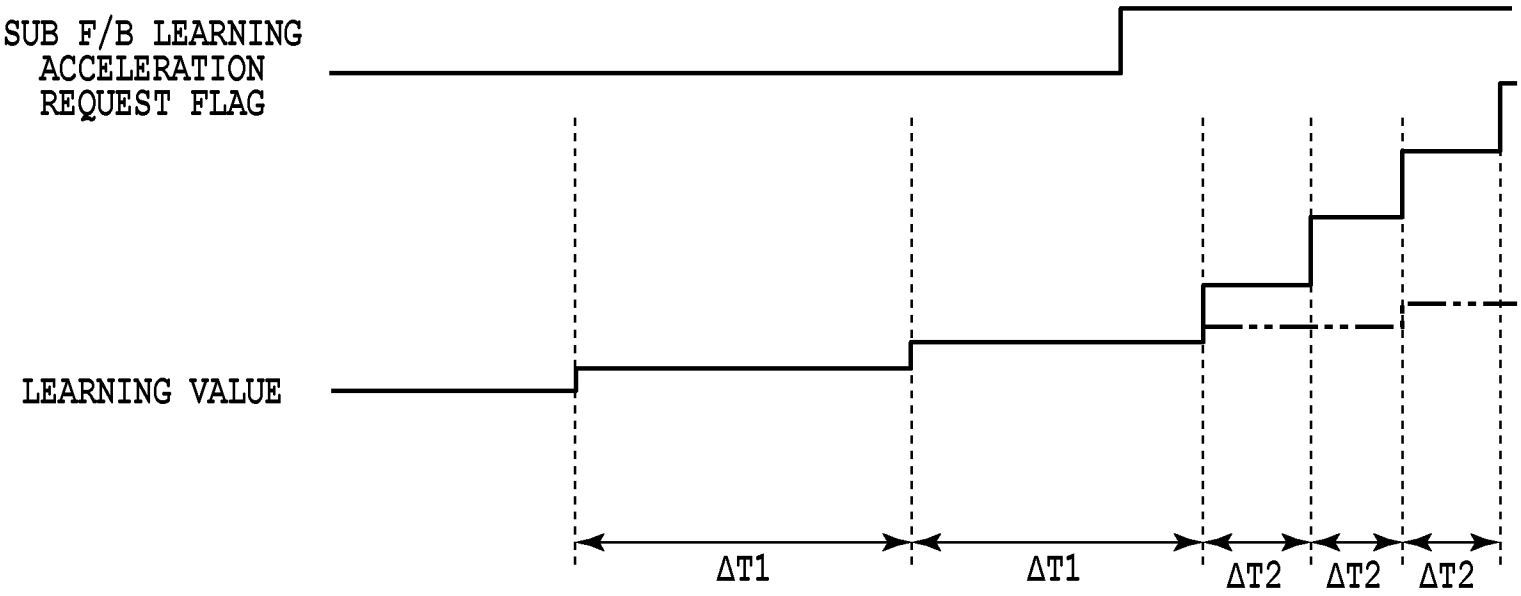
FIG. 15 is a time chart schematically showing transition of a learning value observed when a process of accelerating sub feedback learning and fixing the sub feedback learning speed.

Then, a process of fixing acceleration of the sub feedback learning speed is carried out (S184). The process is a process of increasing an incorporation speed at which, during the above-described learning control (FIG. 7 and FIG. 8), the correction amount for the sub feedback control is incorporated into the learning value, above a normal value. The process is carried out by changing the incorporation rate α and the incorporation interval ΔT. Specifically, as schematically shown in FIG. 15, the process involves increasing the incorporation rate α for the learning control above a normal value (for example, by a factor of 2) and reducing the incorporation interval ΔT below a normal value (for example, to half). As a result, the incorporation speed at which the correction amount for the sub feedback control is incorporated into the learning value is set to a second speed by being increased above a first speed for a normal state when neither the incorporation rate α nor the incorporation interval Δ T is changed (alternate long and two short dashes line).

Then, the number of execution of sub feedback learning operations under acceleration is counted (S185). The counting is repeated until the number of learning operations performed becomes equal to or larger than a predetermined value (S186). When the number of learning operations performed becomes equal to or larger than the predetermined value, the determination in step S186 is affirmative and the process shifts to step S187, where the above-described sub feedback acceleration request flag is turned off. Thus, the monitor condition for the above-described process of setting the guard value (FIG. 10) is satisfied, which condition is that the sub feedback learning acceleration request flag is off. Thus, the process of setting the guard value is permitted to be subsequently carried out. Therefore, when element cracking is occurring in the $O_2$ sensor 18, the correction amount guard control can be enabled by carrying out the process of setting the guard value. This allows suppression of emission degradation that may occur in an excessively rich state resulting from element cracking.

Furthermore, the sub feedback learning acceleration execution history flag is turned on, which indicates that sub feedback learning acceleration has been implemented (S186). This allows the processing succeeding step S182 to be skipped over a certain period or a traveling distance following the subsequent cycles. The flag is turned off under the condition that the certain period has elapsed or the vehicle has traveled over a certain travelling distance, thereby permitting the processing succeeding step S182 to be carried out again.

Finally, the process of fixing acceleration of the sub feedback learning speed is cancelled (S188). Thus, the sub feedback learning speed (that is, the incorporation rate and the incorporation interval ΔT) is returned to the normal value, that is, the first speed, and the process is retuned.

Now, the state of the flags and the learning value when the above-described process of controlling the sub feedback learning speed is carried out will be described in accordance with a timing chart in FIG. 16. It is assumed that a vehicle according to the present embodiment is driven with any acceleration and deceleration repeated (FIG. 16(*a*)). At time t21, when the state where the output value from the $O_2$ sensor is leaner than a predetermined value lasts for a predetermined time or longer (S182, FIG. 16(*b*)), the sub feedback learning speed acceleration request flag (FIG. 16(*d*)) is turned on. Consequently, the second speed, which is higher than the first speed for the normal state, is set for the incorporation speed at which, during the learning control, the correction amount for the sub feedback control is incorporated into the learning value (S184). As a result, the number of times sub feedback has been executed (FIG. 16(*e*)) and the learning value (FIG. 16(*f*)) increase more quickly than in the normal state (alternate long and short dash line and alternate long and two short dashes line). When, at time t22, the number of times sub feedback has been implemented reaches a predetermined value (S186), the sub feedback learning speed acceleration request flag (FIG. 16 (*d*)) is turned off, and the sub feedback learning acceleration execution history flag (FIG. 16(*b*)) is turned on (S187).

Figure 16:
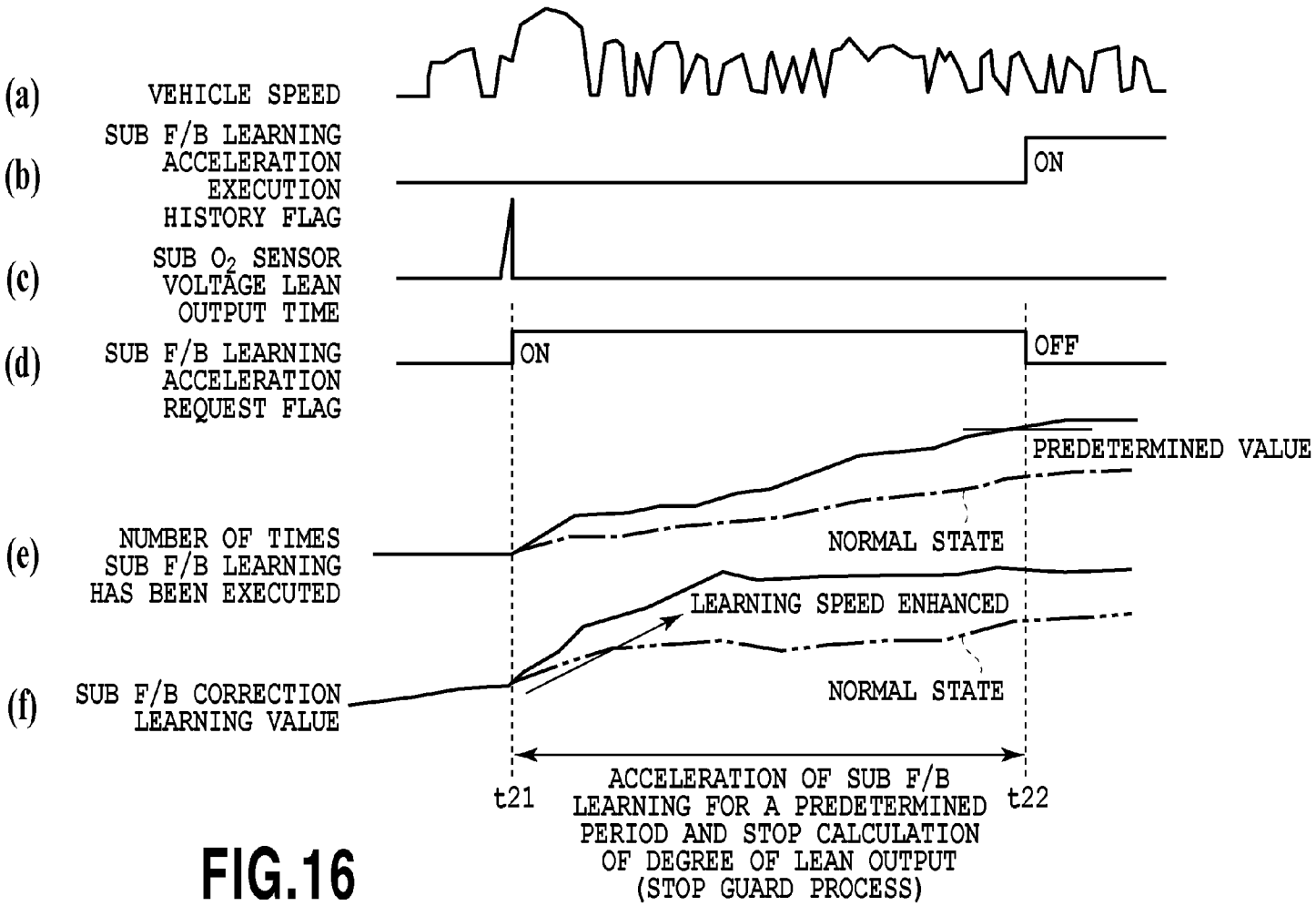
FIG. 16 is a time chart showing transition of flags, the learning value, and other statuses observed when the process of controlling the sub feedback learning speed is carried out.

Furthermore, according to the present embodiment, when the sub feedback learning speed acceleration request flag (FIG. 16(*d*)) is on, the execution of the correction amount guard control is inhibited (step S161 of the process of setting the guard value in FIG. 10).

Figure 17:
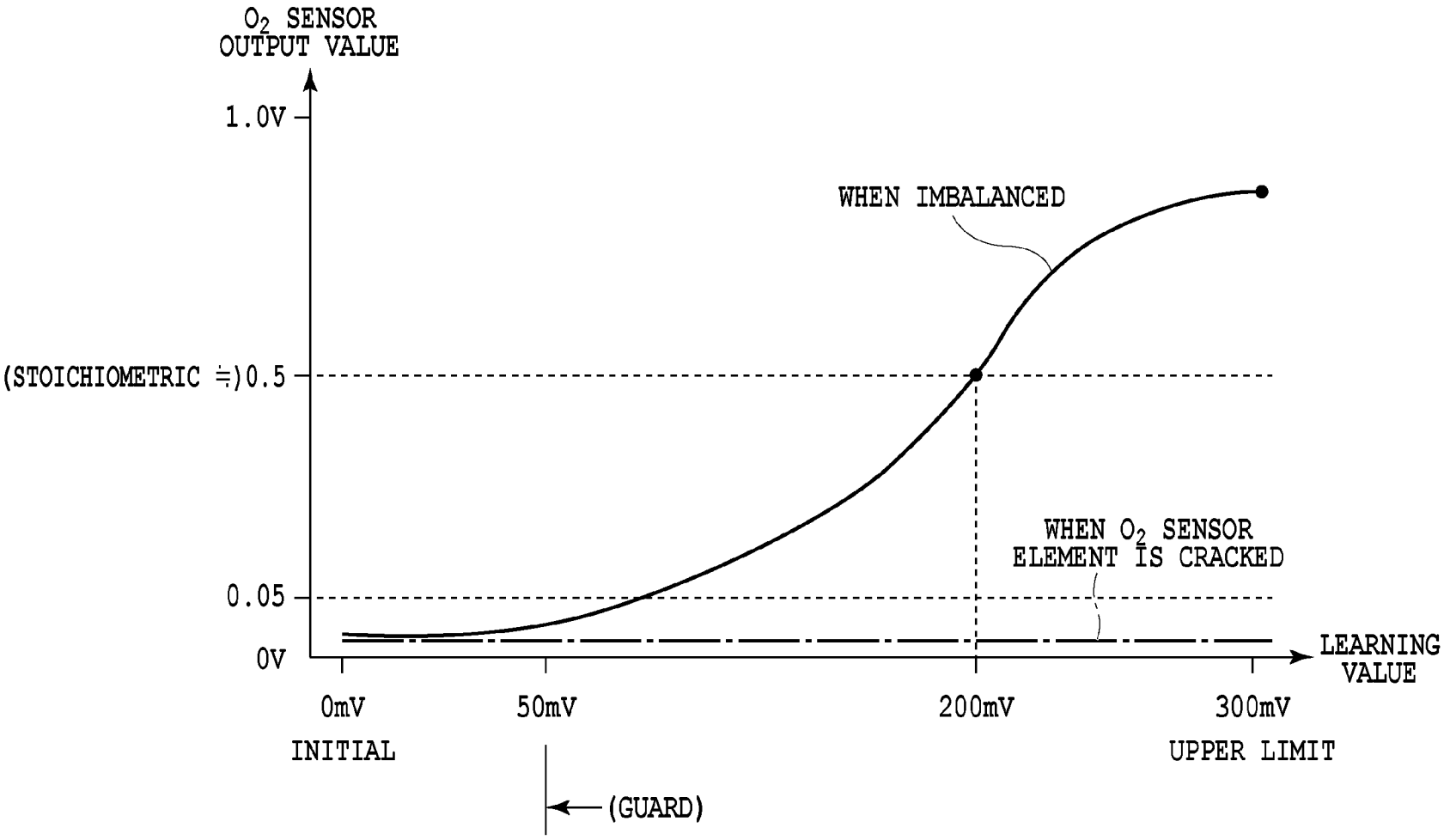
FIG. 17 is a graph showing a relation between the learning value and the output value from the $O_2$ sensor during learning control.

FIG. 17 is a graph showing a relation between the learning value for the learning control and the output value from the $O_2$ sensor 18. As described above, the detection value from the $O_2$ sensor is leaner than the actual air-fuel ratio both in the case where element cracking occurs in the $O_2$ sensor 18 (alternate long and short dash line) and in the case where inter-cylinder air-fuel ratio imbalance occurs (solid line). These two cases are difficult to distinguish particularly when the learning value is relatively small. Thus, in a configuration provided before disclosure of an improvement according to the present invention and implementing correction amount guard control allowing the correction amount for the air-fuel ratio control to be adjusted, the case where element cracking occurs in the $O_2$ sensor 18 (alternate long and short dash line) is difficult to distinguish from the case where inter-cylinder air-fuel ratio imbalance occurs (solid line) as a result of the correction amount being guarded within a relatively small region (for example, a 50-mV-equivalent region of the $O_2$ sensor detection value). In contrast to this, according to the present embodiment, when the learning value increases (for example, the learning value becomes equivalent to an $O_2$ sensor detection value of 300 mV) to make the actual air-fuel ratio richer, a commensurate change occurs in the output value from the $O_2$ sensor 18 in the case of inter-cylinder air-fuel ratio imbalance. On the other hand, in the case of element cracking in the $O_2$ sensor 18, the state where the output value from the $O_2$ sensor 18 is leaner than a predetermined value (for example, 0.05 V) lasts for a predetermined time or longer. This enables the two cases to be clearly distinguished from each other.

As thus described in detail, if the state where the output value from the $O_2$ sensor 18 is leaner than the predetermined value lasts for the predetermined time or longer (S182), then during the learning control, the incorporation speed at which the correction amount for the sub feedback control is incorporated into the learning value is set to the second speed, which is higher than the first speed for the normal state (S184). As a result, the progress of the learning for the learning control allows information on the output state of the $O_2$ sensor to be more quickly acquired. This enables acceleration of the distinction between the case where element cracking in the $O_2$ sensor 18 and the case where inter-cylinder air-fuel ratio imbalance occurs.

Furthermore, according to the present embodiment, if the state where the output value from the $O_2$ sensor 18 is leaner than the predetermined value lasts for the predetermined time or longer, the correction amount guard control is suppressed from being performed until the learning control is completed (step 161 of the process of setting the guard value in FIG. 10). Thus, even though the apparatus implements the correction amount guard control, an air-fuel ratio correction amount sufficient to determine the presence or absence of inter-cylinder air-fuel ratio imbalance can be provided before the learning control is completed. This enables the inter-cylinder air-fuel ratio imbalance determination to be facilitated. Furthermore, when the learning control is completed, the suppression of the correction amount guard control is cancelled. Consequently, the correction amount guard control enables emission degradation to be suppressed after the learning control is completed.

The present invention is not limited to the above-described aspects but includes any variations, applications, and equivalents embraced in the concepts of the present invention defined by the claims. Thus, the present invention should not be interpreted in a limited manner and is applicable to any other techniques belonging to the scope of the concepts of the present invention.

For example, the imbalance detection according to the above-described embodiment uses the average value A/FAV of the output difference ΔA/Fn. However, any other parameter may be used provided that the parameter is correlated with the degree of fluctuation in output. Furthermore, the above-described embodiment utilizes only the air-fuel ratio sensor output during a decrease (during a change toward the rich side) to detect rich shift abnormality. However, an aspect is possible in which only the air-fuel ratio sensor output during an increase (during a change toward the lean side) is utilized or in which the air-fuel ratio output both during a decrease and during an increase is utilized. Furthermore, not only the rich shift abnormality but also lean shift abnormality can be detected, and air-fuel ratio imbalance may be generally detected without the distinction between the rich shift abnormality and the lean shift abnormality.

Moreover, as a configuration detecting inter-cylinder air-fuel ratio imbalance, any other configuration may be adopted which detects inter-cylinder air-fuel ratio imbalance based on the output values from the upstream sensor and the downstream sensor. For example, with focus placed on an extreme increase in the amount of hydrogen in exhaust observed when the air-fuel ratio shifts to the rich side in some cylinders and on removal of the hydrogen from the exhaust for purification using the catalyst, the inter-cylinder air-fuel ratio imbalance may be detected based on the state of a deviation between the detection value from the A/F sensor and the detection value from the $O_2$ sensor, as is the case with the apparatus described in Patent Literature 3.

Furthermore, in the process of fixing acceleration of the learning speed (S184), it is possible to set the amount of change in learning value per incorporation to a sufficiently larger fixed value than in the normal state instead of changing the incorporation rate α. For the process of fixing acceleration of the learning speed, the learning may be accelerated to increase the learning speed compared to the learning speed in the normal state. For example, it is possible to change only one of the two values, the incorporation interval ΔT, and the incorporation rate α or the amount of change in learning value per incorporation.

Additionally, according to the above-described embodiment, if the state where the output value from the $O_2$ sensor 18 is leaner than the predetermined value lasts for the predetermined time or longer, the correction amount guard control is prohibited from being performed until the learning control is completed (S183). However, the amount of the correction amount guard control may be reduced compared to the amount of the correction amount guard control in the normal state in order to suppress performance of the correction amount guard control. This does not depart from the scope of the present invention as long as the process of guarding the correction amount is suppressed more significantly than in the normal state.

REFERENCE SIGNS LIST

1 Internal combustion engine
2 Combustion chamber
3 Air flow meter
4 Exhaust pipe
11 Catalyst
12 Injector
12 Exhaust manifold
17 A/F sensor
18 $O_2$ sensor
20 Electronic control unit (ECU)

The invention claimed is:

1. An air-fuel ratio control apparatus for an internal combustion engine comprising:

an upstream sensor provided on an upstream side of an exhaust emission control catalyst in an exhaust system of a multi-cylinder internal combustion engine and configured to detect an air-fuel ratio state based on an exhaust component, a downstream sensor provided on a downstream side of the exhaust emission control catalyst in the exhaust system and configured to detect the air-fuel ratio state based on the exhaust component; and a controller configured to control the internal combustion engine, the controller being programmed to perform:

main feedback control controlling a fuel supply amount so as to make an exhaust air-fuel ratio equal to a target air-fuel ratio based on an output value from the upstream sensor;

sub feedback control allowing correction of the fuel supply amount so as to make an exhaust air-fuel ratio equal to the target air-fuel ratio using a correction amount set based on an output value from the downstream sensor;

correction amount guard control allowing adjustment of the correction amount by setting a limit on the correction amount when an appearance frequency of a state where the output value from the downstream sensor is leaner than a predetermined value is equal to or higher than a predetermined value;

learning control allowing calculation of a learning value corresponding to a constant deviation between the output value from the upstream sensor and an actual exhaust air-fuel ratio in such a manner that the learning value incorporates at least a part of the correction amount and allowing correction of the fuel supply amount based on the calculated learning value;

sensor abnormality detection control allowing detection of abnormality in the downstream sensor based on the learning value calculated by the learning control and the output value from the downstream sensor; and imbalance determination control allowing determination of air-fuel ratio imbalance among cylinders based on the output values from the upstream sensor and the downstream sensor, wherein the controller is further programmed to:

set an incorporation speed at which, during the learning control, the correction amount is incorporated into the learning value to a first speed when a state where the output value from the downstream sensor is leaner than the predetermined value lasts for a duration shorter than a predetermined time, and set the incorporation speed to a second speed higher than the first speed and suppress performance of the correction amount guard control until the learning control is completed, when the duration is equal to or longer than the predetermined time.

2. The air-fuel ratio control apparatus for the internal combustion engine according to claim 1, wherein the controller is further programmed to cancel suppression of performance of the correction amount guard control when the learning control is completed.

* * * * *